US009200431B2

(12) United States Patent
Mori et al.

(10) Patent No.: US 9,200,431 B2
(45) Date of Patent: Dec. 1, 2015

(54) HYDRAULIC DRIVE SYSTEM FOR CONSTRUCTION MACHINE

(75) Inventors: Kazushige Mori, Koka (JP); Yasutaka Tsuruga, Moriyama (JP); Kiwamu Takahashi, Koka (JP); Yoshifumi Takebayashi, Koka (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 433 days.

(21) Appl. No.: 13/641,571

(22) PCT Filed: Mar. 9, 2011

(86) PCT No.: PCT/JP2011/055550

§ 371 (c)(1),
(2), (4) Date: Oct. 16, 2012

(87) PCT Pub. No.: WO2011/148693

PCT Pub. Date: Dec. 1, 2011

(65) Prior Publication Data

US 2013/0055705 A1 Mar. 7, 2013

(30) Foreign Application Priority Data

May 24, 2010 (JP) ..... 2010-118594

(51) Int. Cl.
*F15B 9/17* (2006.01)
*E02F 9/22* (2006.01)
*F15B 11/16* (2006.01)

(52) U.S. Cl.
CPC ..... *E02F 9/2232* (2013.01); *E02F 9/2285* (2013.01); *E02F 9/2296* (2013.01);
(Continued)

(58) Field of Classification Search
CPC .... F15B 11/163; F15B 11/165; F15B 11/167; F15B 2211/253; F15B 2211/20553; F15B 2211/6355; F15B 2211/30535; E02F 9/2232; E02F 9/2285
USPC ..... 60/452; 91/446, 447
See application file for complete search history.

(56) References Cited

U.S. PATENT DOCUMENTS 6,202,411 B1 * 3/2001 Yamashita ..... 60/445
6,584,770 B2 * 7/2003 Tsuruga et al. ..... 60/422

(Continued)

FOREIGN PATENT DOCUMENTS

JP 04-247131 A 9/1992
JP 09-165792 A 6/1997

(Continued)

OTHER PUBLICATIONS

International Search Report received in International Application No. PCT/JP2011/055550 dated Dec. 20, 2012.

*Primary Examiner* — Dwayne J White
*Assistant Examiner* — Matthew Wiblin
(74) *Attorney, Agent, or Firm* — Mattingly & Malur, PC

(57) ABSTRACT

A hydraulic drive system for a construction machine has a travel detection device which detects whether or not the operation mode is a traveling operation and a setting changing device. The setting changing device sets the target differential pressure of load sensing control at an absolute pressure Pa when the operation mode is not a traveling operation, and sets the target differential pressure of the load sensing control at an absolute pressure Pa' rather than the absolute pressure Pa. In this way, in the actuator operation other than traveling, a necessary actuator speed can be obtained and supplied with the necessary maximum flow rate. In addition, during the combined operation, a flow rate in accordance with the opening area ratios of flow control valves can be distributed to actuators different in load pressure from one another; and energy efficiency is enhanced due to less energy loss during traveling operation.

2 Claims, 10 Drawing Sheets

(52) U.S. Cl.
CPC ..... *F15B11/163* (2013.01); *F15B 2211/253* (2013.01); *F15B 2211/30535* (2013.01); *F15B 2211/6355* (2013.01); *F15B 2211/71* (2013.01)

(56) References Cited

U.S. PATENT DOCUMENTS

| | | | | |
|---|---|---|---|---|
| 2003/0019681 | A1* | 1/2003 | Nakamura | 180/307 |
| 2003/0200747 | A1* | 10/2003 | Matsumoto et al. | 60/452 |
| 2004/0123499 | A1 | 7/2004 | Arii | |
| 2009/0031719 | A1* | 2/2009 | Tsuruga et al. | 60/420 |

FOREIGN PATENT DOCUMENTS

| | | | |
|---|---|---|---|
| JP | 2001-193705 | A | 7/2001 |
| JP | 2004-205019 | A | 7/2004 |
| JP | 2010-107009 | A | 5/2010 |
| WO | 2010/050305 | A1 | 5/2010 |

* cited by examiner

① : WHEN THE TRAVELING REMOTE CONTROL VALVE IS NEUTRAL

② : WHEN THE TRAVELING REMOTE CONTROL VALVE IS UNDER OPERATION

P0 : PILOT PRESSURE WHEN THE TRAVELING REMOTE CONTROL VALVE IS NEUTRAL

P1 : PILOT PRESSURE WHEN THE TRAVELING REMOTE CONTROL VALVE IS UNDER OPERATION

HYDRAULIC DRIVE SYSTEM FOR CONSTRUCTION MACHINE

TECHNICAL FIELD

The present invention relates to a hydraulic drive system for a construction machine equipped with a traveling motor such as a hydraulic excavator. More particularly, the invention relates to a hydraulic drive system for a construction machine in which energy efficiency of a hydraulic mini-excavator during its traveling can be improved.

BACKGROUND ART

A hydraulic drive system, which is sometimes called a load sensing system, controls the delivery flow rate of a hydraulic pump so that the delivery pressure of the hydraulic pump (main pump) is higher than the maximum load pressure of a plurality of actuators by a target differential pressure. Such a load sensing system is configured such that differential pressures across a plurality of flow control valves are each kept at a given differential pressure by a pressure compensating valve so that a hydraulic fluid can be fed to the plurality of actuators at a ratio depending on opening areas of the flow control valves regardless of the load pressures during the combined operation in which the actuators are simultaneously driven.

The load sensing system described above exercises control as follows: a differential pressure (hereinafter, called the differential pressure PLS) between a delivery pressure of the hydraulic pump and the maximum load pressure of the plurality of actuators is led to pressure compensating valves; a target compensating differential pressure of each pressure compensating valve is set based on the differential pressure PLS; and a differential pressure across the flow control valve is kept at the differential pressure PLS. During the combined operation where the plurality of actuators are simultaneously driven, a saturation state where the delivery flow rate of the hydraulic pump is insufficient may occur. In such a state, the differential pressure PLS is lowered depending on the degree of the saturation and the target compensating differential pressure of the pressure compensating valve, i.e., the differential pressure across the flow control valve is reduced. Thus, the delivery rate of the hydraulic pump can be redistributed at a ratio of flow rates demanded by the respective actuators.

In patent document 1, the load sensing system described above is provided with a differential pressure reducing valve which outputs, as an absolute pressure, the differential pressure PLS between the delivery pressure of the hydraulic pump and the maximum load pressure of the plurality of actuators. The output pressure of the differential pressure reducing valve is led to the plurality of pressure compensating valves to set respective target compensating differential pressures. The load sensing system is provided with a differential pressure reducing valve which outputs, as an absolute pressure, the pressure according to the revolution speed of an engine driving the hydraulic pump. The output pressure of this differential pressure reducing valve is led to a load sensing control regulator and the target differential pressure of the load sensing control is set as a variable value according to the revolution speed of the engine.

PRIOR ART DOCUMENT

Patent Document

Patent Document 1: JP,A 2001-193705

SUMMARY OF THE INVENTION

Problem to be Solved by the Invention

The conventional load sensing system exercises control as follows: the delivery flow rate of the hydraulic pump is controlled so that the delivery pressure of the hydraulic pump is higher than the maximum load pressure of the actuators by the same target differential pressure regardless of the type of the driven actuator; the differential pressure PLS between the delivery pressure of the hydraulic pump and the maximum load pressure is led to the pressure compensating valves; and the differential pressures across the corresponding flow control valves are kept at the same differential pressure PLS. Holding the differential pressures PLS across the corresponding flow control valve during the complex combined operation is necessary to distribute a flow rate in accordance with the opening area ratios of the flow control valves to the actuators different in load pressure from one another. However, if the actuator is a traveling motor, the differential pressure PLS leads to energy loss during traveling operation.

More specifically, the maximum flow rate required by the traveling motor is compared with that required by another actuator such as a boom cylinder, an arm cylinder or the like. In this case, the maximum flow rate required by the traveling motor is lower than that required by another actuator. Differential pressures across all the flow control valves have been controlled in the same way in the past. In order to make the maximum flow rate required by a traveling motor lower than that required by another actuator, the maximum opening area of the traveling flow control valve has been set to be smaller than that of the flow control valve for another actuator. In this case, the maximum opening area of the flow control valve for actuator operation other than traveling is large; therefore, the maximum flow rate required for the actuator is fed thereto via the flow control valve at a relatively small losing pressure, thereby providing a required actuator speed. The flow rate in accordance with the opening area ratios of the flow control valves can be distributed to the actuators different in load pressure from one another during the combined operation by the pressure compensating valves controlling the differential pressures across the flow control valves. Thus, smooth operation can be done. However, for the traveling operation, the maximum opening area of the flow control valve is smaller than that of other actuators. Therefore, when the hydraulic fluid is fed to the traveling motor via the flow control valve, the losing pressure inside the flow control valve is increased in accordance with the reduced maximum opening area, thereby energy loss is increased.

It is an object of the present invention to provide a hydraulic drive system for a construction machine in which: in actuator operation other than traveling, a necessary actuator speed can be hitherto obtained by being supplied with the necessary maximum flow rate; a flow rate in accordance with the opening area ratios of flow control valves can be distributed to actuators different in load pressure from one another during combined operation; and energy efficiency is enhanced due to less energy loss during traveling operation.

Means for Solving the Problem (1) To solve the above problem, the present invention is a hydraulic drive system for a construction machine, comprising: an engine; a variable displacement main pump driven by the engine; a plurality of actuators including traveling hydraulic motors, each of the traveling hydraulic motors being driven by a hydraulic fluid delivered from the main pump; a plurality of flow control valves including traveling flow control valves, each of the traveling flow control valves controlling a flow rate of the hydraulic fluid fed to the plurality of actuators from the main pump; a plurality of pressure compensating valves for controlling differential pressures across the plurality of flow control valves; and a pump control device for exercising load sensing control on a displacement volume of the main pump so that the delivery pressure of the main pump is higher than a maximum load pressure of the plurality of actuators by a target differential pressure; the plurality of pressure compensating valves each controlling a differential pressure across a corresponding one of the flue control valves so that the differential pressure across the flow control valve is kept at a differential pressure between a delivery pressure of the main pump and the maximum load pressure of the plurality of actuators, the hydraulic drive system comprising: a travel detection device for detecting whether or not the operation mode is a traveling operation at which the traveling motor is to be driven; and a setting changing device, on the basis of a detection result of the traveling detection device, for setting the target differential pressure of the load sensing control at a first prescribed value when the operation mode is not a traveling operation, and setting the target differential pressure of the load sensing control at a second prescribed value when the operation mode is a traveling operation.

As described above, the travel detection device and the setting changing device are installed. The target differential pressure of the load sensing control is set at the first prescribed value when the operation mode is not a traveling operation while the target differential pressure is set at the second prescribed value smaller than the first prescribed value when the operation mode is a traveling operation. In the actuator operation other than traveling, the first prescribed value is set as the target differential pressure of the load sensing control and a necessary actuator speed can be hitherto obtained by being supplied with the necessary maximum flow rate. In addition, during the combined operation, a flow rate in accordance with the opening area ratios of flow control valves can be distributed to actuators different in load pressure from one another during combined operation; and energy efficiency is enhanced due to less energy loss during traveling operation. In the traveling operation, the second prescribed value smaller than the first prescribed value is set as the target differential pressure of the load sensing control. Therefore, also the differential pressure across the traveling flow control valve controlled by the pressure compensating valve is reduced accordingly to reduce the losing pressure inside the flow control valve. As a result, energy loss can be reduced and improvement in energy efficiency is possible.

(2) In above (1), preferably, the setting changing device includes a signal pressure production device, the signal pressure production device producing a first absolute pressure corresponding to the first prescribed value and outputting the first absolute pressure as a signal pressure when the operation mode is not a traveling operation, and producing a second absolute pressure corresponding to the second prescribed value and outputting the second absolute pressure as a signal pressure when the operation mode is a traveling operation; and the pump control device sets the signal pressure output by the signal pressure production device as the target differential pressure of the load sensing control and controls the displacement volume of the main pump.

With this, the configuration of the pump control device can be cost less, since the pump control device can be configured hydraulically.

(3) In the above (2), preferably, the signal pressure production device includes: a differential pressure reducing valve for producing, as the first absolute pressure, a pressure depending on the revolution speed of the engine driving the main pump and outputs the first absolute pressure; a pressure reducing device for reducing pressure of a pilot hydraulic fluid source to produce and outputting the second absolute pressure; and a switching device for switching between the first absolute pressure is output as the signal pressure when the operation mode is not a traveling operation and the second absolute pressure is output as the signal pressure when the operation mode is a traveling operation.

With this, the configuration of the signal pressure production device can be cost less due to the efficiency in the hydraulic system in the whole the signal pressure production device.

(4) In the above (3), preferably, the pressure reducing device is a pressure reducing valve for reducing the pressure of the pilot hydraulic fluid source to produce and output the second absolute pressure.

With that, the pressure reducing device can be configured by use of a pressure reducing valve which is an inexpensive hydraulic part.

(5) In the above (2), preferably, the signal pressure production device includes: a pilot pump driven by the engine; a flow rate detection valve installed in a hydraulic line through which a delivery fluid of the pilot pump passes to change a differential pressure across the flow rate detection valve in accordance with a passing flow rate; and a differential pressure reducing valve for producing the differential pressure across the flow rate detection valve as the first absolute pressure and outputting the first absolute pressure; wherein the flow rate detection valve has a pressure-receiving portion adapted to receive a control pressure when the operation mode is a traveling operation and act to open a variable restrictor portion of the flow rate detection valve; the differential pressure reducing valve produces, as the first absolute pressure, the differential pressure across the flow rate detection valve in which the control pressure is not led to the pressure-receiving portion and outputs the first absolute pressure when the operation mode is not a traveling operation, and the differential pressure reducing valve produces, as the second absolute pressure, the differential pressure across the flow rate detection valve in which the control pressure is led to the pressure-receiving portion and outputs the second absolute pressure when the operation mode is a traveling operation.

With that, the second absolute pressure can be switched from the first absolute pressure only by leading the control pressure to the flow rate detection valve. Therefore, the signal pressure production device can be composed of a small number of component parts.

(6) In the above (2), preferably, the signal pressure production device includes: a control unit which receives a detection signal of the travel detection device, determines whether or not the operation mode is a traveling operation on the basis of the detection signal, and outputs a control electric signal when the operation mode is not a traveling operation; and a solenoid proportional pressure reducing valve which produces and outputs the first absolute pressure when the control electric signal is not output from the control unit while produces and outputs the second absolute pressure when the control electric signal is output from the control unit.

With that, the control electric signal can arbitrarily be changed by the arithmetic processing of the control unit to freely regulate the second absolute pressure.

Effect of the Invention

According to the present invention, in the actuator operation other than traveling, a necessary actuator speed can be hitherto obtained by being supplied with the necessary maximum flow rate. In addition, during the combined operation, a flow rate in accordance with the opening area ratios of flow control valves can be distributed to actuators different in load pressure from one another during combined operation; and energy efficiency is enhanced due to less energy loss during traveling operation.

MODE FOR CARRYING OUT THE INVENTION

Embodiments of the present invention will hereinafter be described with reference to the drawings.

<First Embodiment>

Figure 1:
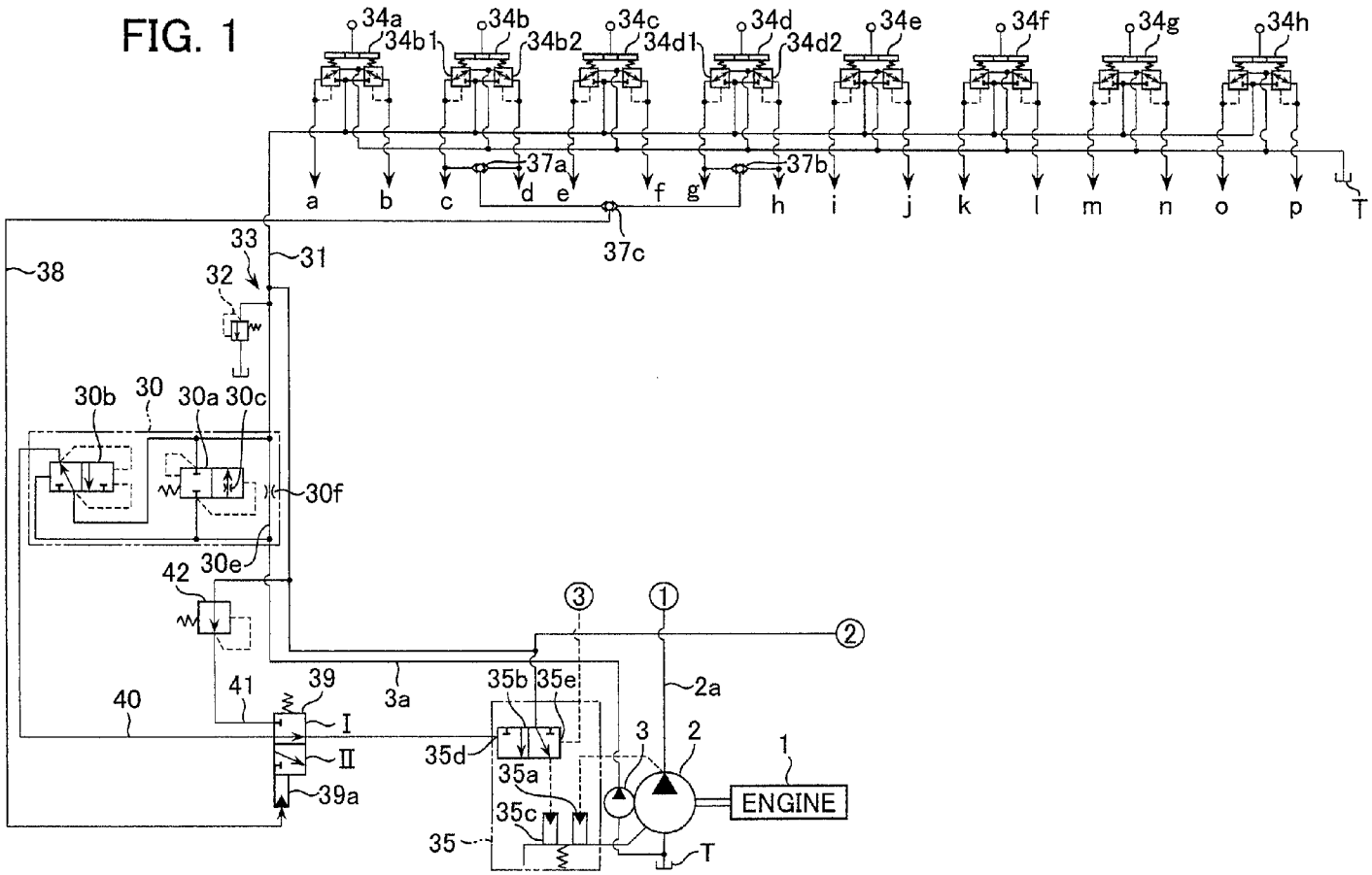
FIG. 1 illustrates a configuration of a hydraulic drive system for a construction machine according to a first embodiment of the present invention, specifically, a portion, other than a control valve, of the hydraulic drive system.
Figure 2:
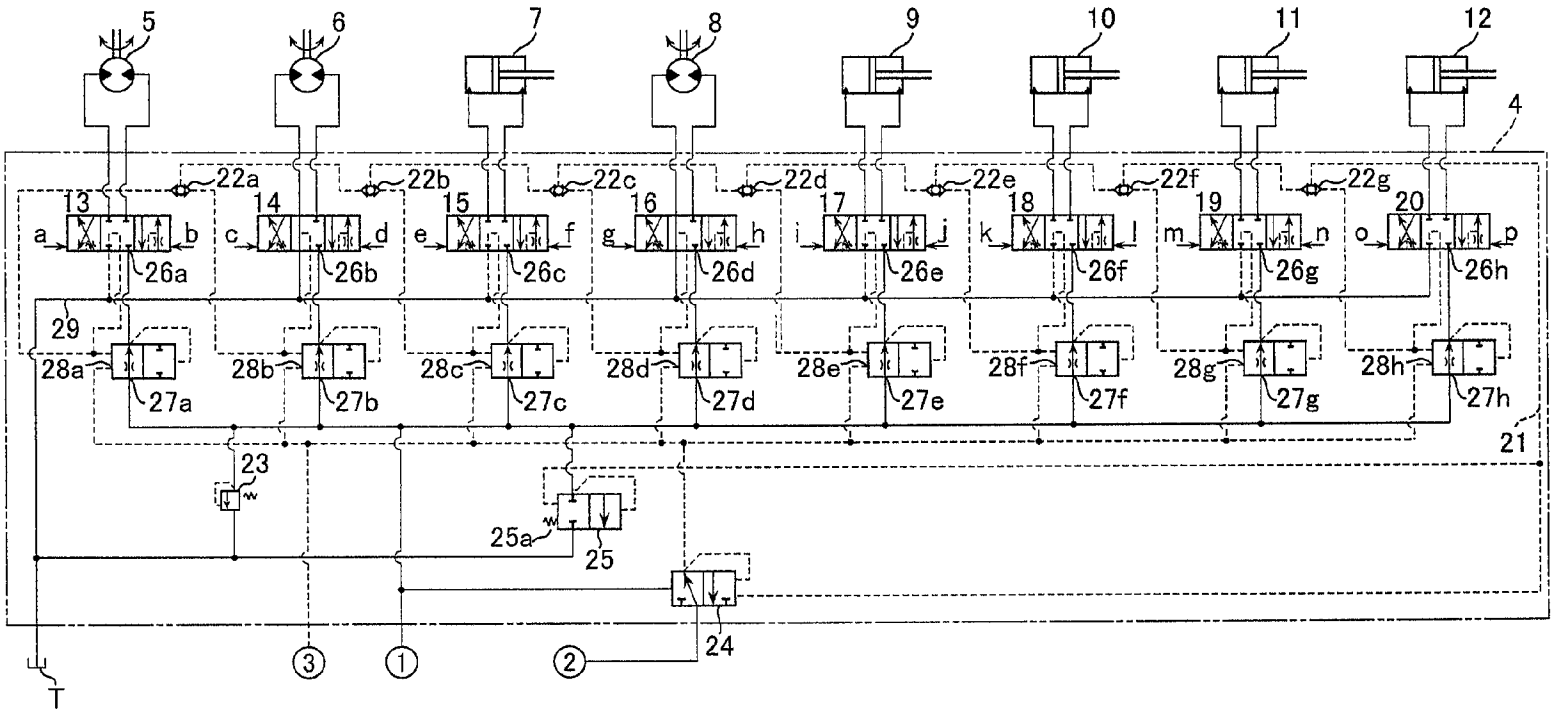
FIG. 2 illustrates a configuration of the hydraulic drive system for a construction machine according to the first embodiment of the present invention, specifically, a portion, corresponding to the control valve, of the hydraulic drive system.

FIGS. 1 and 2 illustrate a configuration of a hydraulic drive system for a construction machine according to a first embodiment of the present invention. FIG. 1 illustrates a portion, other than a control valve, of the hydraulic control system. FIG. 2 illustrates the control valve of the hydraulic drive system. The connection relationship between the control valve and the other portions of the hydraulic drive system are indicated with encircled numbers 1, 2 and 3.

The hydraulic drive system of the embodiment includes an engine 1; a main hydraulic pump (hereinafter called the main pump) 2 driven by the engine 1; a pilot pump 3 driven by the engine 1 in conjunction with the main pump 2; a plurality of actuators 5, 6, 7, 8, 9, 10, 11 and 12 driven by hydraulic fluid discharged from the main pump 2; and a control valve 4.

The construction machine according to the present embodiment is e.g. a hydraulic excavator. The actuator 5 is a turning motor for the hydraulic excavator. The actuators 6, 8 are left and right traveling motors. The actuator 7 is a blade cylinder and the actuator 9 is a swing cylinder. The actuators 10, 11 and 12 are a boom cylinder, an arm cylinder and a bucket cylinder, respectively.

The control valve 4 is connected to a supply hydraulic line 2*a* of the main pump 2. The control valve 4 includes a plurality of valve sections 13, 14, 15, 16, 17, 18, 19, and 20; a plurality of shuttle valves 22*a*, 22*b*, 22*c*, 22*d*, 22*e*, 22*f*, and 22*g*; a main relief valve 23; a differential pressure reducing valve 24; and an unloading valve 25. The valve sections 13, 14, 15, 16, 17, 18, 19, and 20 control the direction and flow rate of the hydraulic fluid supplied to each of the actuators from the main pump 2. The shuttle valves 22*a*, 22*b*, 22*c*, 22*d*, 22*e*, 22*f*, and 22*g* select the highest load pressure (hereinafter, called the maximum load pressure) PLmax among the load pressures of the plurality of actuators 5, 6, 7, 8, 9, 10, 11, and 12 and output the PLmax to a signal hydraulic line 21. The main relief valve 23 is installed in the supply hydraulic line 2*a* of the main pump 2 to limit the maximum delivery pressure (the maximum pump pressure) of the main pump 2. The differential pressure reducing valve 24 outputs, as an absolute pressure, a differential pressure PLS between the delivery pressure (the pump pressure) Pd of the main pump 2 and the maximum load pressure PLmax. The unloading valve 25 returns a part of the discharge rate of the main pump 2 to a tank T to keep the differential pressure PLS at a given value or lower set by a spring 25*a* when the differential pressure PLS between the pump pressure Pd and the maximum load pressure PLmax exceeds a given value set by the spring 25*a*. The unloading valve 25 and the main relief valve 23 have exits connected via a tank hydraulic line 29 to the tank T in the control valve 4.

The valve section 13 includes a flow control valve (a main spool) 26*a* and a pressure compensating valve 27*a*. The valve section 14 includes a flow control valve (a main spool) 26*b* and a pressure compensating valve 27*b*. The valve section 15 includes a flow control valve (a main spool) 26*c* and a pressure compensating valve 27*c*. The valve section 16 includes a flow control valve (a main spool) 26*d* and a pressure compensating valve 27*d*. The valve section 17 includes a flow control valve (a main spool) 26*e* and a pressure compensating valve 27*e*. The valve section 18 includes a flow control valve (a main spool) 26*f* and a pressure compensating valve 27*f*. The valve section 19 includes a flow control valve (a main spool) 26*g* and a pressure compensating valve 27*g*. The valve section 20 includes a flow control valve (a main spool) 26*h* and a pressure compensating valve 27*h*.

The flow control valves 26*a*-26*h* control the direction and flow rate of the hydraulic fluid fed to the corresponding actuators 5-12. Each of the pressure compensating valves 27*a*-27*h* controls a differential pressure across a corresponding one of the flow control valves 26*a*-26*h*.

The pressure compensating valves 27*a*-27*h* have opening side pressure-receiving portions 28*a*, 28*b*, 28*c*, 28*d*, 28*e*, 28*f*, 28*g*, and 28*h*, respectively, for setting target differential pressure. The output pressure of the differential pressure reducing valve 24 is led to the pressure-receiving portions 28*a*-28*h* to set a target compensating differential pressure. The target compensating differential pressure is set in accordance with the absolute pressure (hereinafter, refer to as the absolute pressure PLS) of the differential pressure between PLS between the hydraulic pump pressure Pd and the high-load pressure PLmax. As described above, the differential pressures across the flow control valves 26*a*-26*h* are controlled to a value, i.e., the same differential pressure PLS. The pressure compensating valves 27*a*-27*h* exercise control so that the differential pressure across each of the flow control valves 26*a*-26*h* is equal to the differential pressure PLS between the hydraulic pump pressure Pd and the maximum load pressure PLmax. During the combined operation in which the plurality of actuators are simultaneously driven, the delivery flow rate of the main pump 2 is distributed in accordance with the opening area ratios of the flow control valves 26*a*-26*h* regardless of the load pressures of the actuators 5-12. Thus, the combined operability can be secured. In the saturation state where the delivery flow rate of the main pump 2 is not satisfy a demanded flow rate, the differential pressure PLS is lowered according to the degree of the shortage of supply. In accordance with the lowered differential pressure PLS the differential pressures across the flow control valves 26*a*-26*h* controlled by the respective pressure compensating valves 27*a*-27*h* are reduced at the same rate. Accordingly, the passing flow rates of the flow control valves 26*a*-26*h* are reduced at the same ratio. Also in this case, the discharge flow rate of the main pump 2 is distributed to the actuators 5-12 corresponding to the opening area ratios of the flow control valves 26*a*-26*h*. Thus, the combined operability can be secured.

The hydraulic drive system includes an engine revolution speed detection valve device 30, a pilot hydraulic fluid source 33, and control lever devices 34*a*, 34*b*, 34*c*, 34*d*, 34*e*, 34*f*, 34*g*, and 34*h*. The engine revolution speed detection valve device 30 is connected to a supply hydraulic line 3*a* of a pilot pump 3 to output an absolute pressure according to the delivery flow rate of the pilot pump 3. The pilot hydraulic fluid source 33 is connected to the downstream side of the engine revolution speed detection valve device 30 and has a pilot relief valve 32 which keeps the pressure of the pilot hydraulic line 31 constant. The control lever devices 34*a*, 34*b*, 34*c*, 34*d*, 34*e*, 34*f*, 34*g*, and 34*h* are connected to the pilot hydraulic line 31 and have respective remote control valves. The remote control valves use the hydraulic pressure of the pilot hydraulic fluid source 33 as source pressure to produce corresponding pilot pressures a, b, c, d, e, f, g, h, i, j, k, l, m, n, o, and p for operating the corresponding flow control valves 26*a*-26*h*.

The engine revolution speed detection valve device 30 includes a hydraulic line 30*e* connecting the supply hydraulic line 3*a* of the pilot pump 3 with the pilot hydraulic line 31; a restrictor element (a fixed restrictor) 30*f* installed in the hydraulic line 30*e*; a flow rate detection valve 30*a* connected in parallel to the hydraulic line 30*e* and the restrictor element 30*f*; and a differential pressure reducing valve 30*b*. The flow rate detection valve 30*a* has an input side connected to the supply hydraulic line 3*a* of the pilot pump 3 while an output side connected to the pilot hydraulic line 31. The flow rate detection valve 30*a* has a variable restrictor portion 30*a* which increases an opening area as a passing flow rate increases. The hydraulic fluid discharged from the pilot pump 3 passes through both the restrictor element 30*f* and the variable restrictor portion 30*c* of the flow rate detection valve 30*a* and flows toward the pilot hydraulic line 31. At this time, a differential pressure occurs across each of the restrictor element 30*f* and the variable restrictor portion 30*c* of the flow rate detection valve 30*a*, which is increased as the passing flow rate increases. In addition, the differential pressure reducing valve 30*b* outputs the occurred differential pressure as the absolute pressure Pa. The delivery flow rate of the pilot pump 3 varies according to the revolution speed of the engine 1. Therefore, by detecting the differential pressure across each of the restrictor element 30*f* and the variable restrictor portion 30*c*, the discharge flow rate of the pilot pump 3 can be detected and consequently, the revolution speed of the engine 1 can be detected. The variable restrictor portion 30*c* is configured as follows. The opening area is increased as the passing flow rate is increased (as the differential pressure is increased), thereby making the rising degree of the differential pressure more moderate as the passing flow rate is increased.

The main pump 2 is a variable displacement hydraulic pump and is provided with a pump control device 35 for controlling its tilting angle (capacity). The pump control device 35 includes a horsepower control tilting actuator 35*a*, an LS control valve 35*b* and an LS control tilting actuator 35*c*.

The horsepower control tilting actuator 35*a* reduces the tilting angle of the main pump 2 to limit the input torque of the main pump 2 so as not to exceed preset maximum torque when the delivery pressure of the main pump 2 is high. This limits the horsepower consumed by the main pump 2, whereby the stop of the engine 1 (engine stall) due to overloading is prevented.

The LS control valve 35*b* has pressure-receiving portions 35*d*, 35*e* opposed to each other. An absolute pressure Pa (a first prescribed value) produced by the differential pressure reducing valve 30*b* of the engine revolution number detection valve device 30 is led as a target differential pressure (a target LS differential pressure) of load sensing control to the pressure-receiving portion 35*d* via a hydraulic line 40. The absolute pressure PLS produced by the differential pressure reducing valve 24 is led to the pressure-receiving portion 35*e*. If the absolute pressure PLS is higher than the absolute pressure Pa (PLS>Pa), the pressure of the pilot hydraulic fluid source 33 is led to the LS control tilting actuator 35*c* to reduce the tilting angle of the main pump 2. If the absolute pressure PLS is lower than the absolute pressure Pa (PLS<Pa), the LS control tilting actuator 35*c* is allowed to communicate with the tank T to increase the tilting angle of the main pump 2. In this way, the tilting amount (the displacement volume) of the main pump 2 is controlled so that the delivery pressure Pd of the main pump 2 is higher than the maximum load pressure PLmax by the absolute pressure Pa (the target differential pressure). The control valve 35*b* and the LS control tilting actuator 35*c* constitute load-sensing type pump control means for controlling the tilting of the main pump 2 so that the delivery pressure Pd of the main pump 2 is higher than the maximum load pressure PLmax of the plurality of actuators 5, 6, 7, 8, 9, 10, 11, and 12 by the target differential pressure for load sensing control.

Since the absolute pressure Pa is a value varying according to the engine revolution speed, it is used as the target differential pressure of load sensing control. The target compensating differential pressure of each of the pressure compensating valves 27*a*-27*h* is set based on the absolute pressure PLS of the differential pressure between the delivery pressure Pd of the main pump 2 and the maximum load pressure PLmax. Thus, actuator speed control according to the engine revolution speed can be enabled. As described above, the variable restrictor portion 30*c* of the flow rate detection valve 30*a* of the engine revolution speed detection valve device 30 is configured so that the rising degree of the differential pressure across the variable restrictor portion 30*c* is moderate as the passing flow rate is increased. This can achieve the improvement of the saturation phenomenon according to the engine revolution speed, which provides satisfactory fine-operability when the engine revolution speed is set at a low level.

The set pressure of the spring 25*a* of the unloading valve 25 is set at a level higher than the absolute pressure Pa (the target differential pressure for the load sensing control) produced by the differential pressure reducing valve 30*b* of the engine revolution detection valve device 30 when the engine 1 is at a rated maximum revolution speed.

The hydraulic drive system of the present embodiment is characterized in configuration to include a directional control valve 39 and a pressure reducing valve 42. The directional control valve 39 is installed in the hydraulic line 40 adapted to lead the absolute pressure Pa, as the target LS differential pressure, output from the differential pressure reducing valve 30*b* to the pressure-receiving portion 35*d* of the LS control valve 35*b*. The pressure reducing valve 42 is installed in a hydraulic line 41 connecting the pilot hydraulic fluid source 33 with the directional control valve 39, reduces the pressure of the hydraulic fluid of the pilot hydraulic fluid source 33 and outputs an absolute pressure Pa' (a second prescribed value lower than the first prescribed value). The hydraulic drive system is configured to switch the directional control valve 39 to selectively form two circuits: a first hydraulic circuit and a second hydraulic circuit. The first hydraulic circuit leads the absolute pressure Pa, as the target LS differential pressure, produced by the differential pressure reducing valve 30*b* to the pressure-receiving portion 35*d* of the LS control valve 35*b*. The second hydraulic circuit leads the absolute pressure Pa', as the target LS differential pressure, produced from the hydraulic fluid of the pilot hydraulic fluid source 33 via the pressure reducing valve 42, to the pressure-receiving portion 35*d* of the LS control valve 35*b*.

The hydraulic drive system includes shuttle valves 37*a*, 37*b*, and 37*c* assembled in tournament form. The shuttle valves 37*a*, 37*b*, and 37*c* are installed at discharge ports of remote control valves 34*b*1, 34*b*2 of a traveling control lever device 34*b* and of remote control valves 34*d*1, 34*d*2 of a travelling control lever device 34*d*. In addition, the shuttle valves 37*a*, 37*b*, and 37*c* output to a signal hydraulic line 38 the highest pressure as a travel signal pressure among control pilot pressures c, d, g, and h produced by the corresponding travel-operation remote control valves 34*b*1, 34*b*2 and 34*d*1, 34*d*2. The travel signal pressures output from the shuttle valves 37*a*, 37*b*, and 37*c* are led to the pressure-receiving portion 39*a* of the directional control valve 39 via the hydraulic line 38.

The directional control valve 39 has two switching positions: position I and position II. The directional control valve 39 is at position I when both the traveling-operation control lever devices 34*b*, 34*d* are not operated and the travel signal pressure is not led to the pressure-receiving portion 39*a*. When the directional control valve 39 is at position I, the first hydraulic circuit is formed in which the absolute pressure Pa produced by the differential pressure reducing valve 30*b* is led as the target differential pressure to the pressure-receiving portion 35*d* of the LS control valve 35*b*. If the travel-operation control lever devices 34*b*, 34*d* are operated to lead the travel signal pressure to the pressure-receiving portion 39*a*, the directional control valve 39 is switched from position I to position II. When the directional control valve 39 is at position II, the second hydraulic circuit is formed in which the absolute pressure Pa' produced from the hydraulic fluid of the pilot hydraulic fluid source 33 via the pressure reducing valve 42 is led, as the target LS differential pressure, to the pressure-receiving portion 35*d* of the LS control valve 35*b*.

Figure 3:
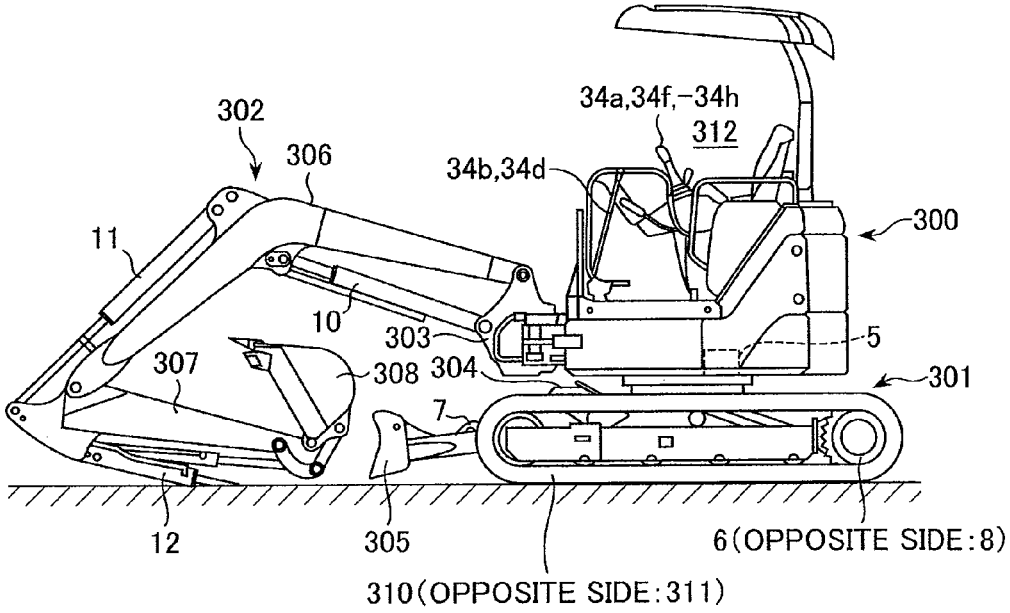
FIG. 3 illustrates appearance of a hydraulic excavator.

FIG. 3 illustrates the appearance of a hydraulic excavator.

Referring to FIG. 3, the hydraulic excavator includes an upper turning structure 300, a lower track structure 301 and a swing type front work device 302. The front work device 302 includes a boom 306, an arm 307 and a bucket 308. The upper turning structure 300 can be turned with respect to the lower track structure 301 by the rotation of a turning motor 5. A swing post 303 is mounted to a front portion of the upper turning structure 300, and to the swing post 303 mounted the front work device 302 that is movable upwards and downwards. The swing post 303 is turnable in a horizontal direction with respect to the upper turning structure 300 by the expansion and contraction of the swing cylinder 9. The boom 306, arm 307 and bucket 308 of the front work device 302 is turnable vertically by the expansion and contraction of a boom cylinder 10, an arm cylinder 11 and a bucket cylinder 12, respectively. The lower track structure 301 is provided with a central frame 304, and to the central frame 304 mounted a blade 305 which is moved upwards and downwards by the expansion and contraction of the blade cylinder 7. The lower track structure 301 travels by allowing travel motors 6 and 8 to be rotated to drive left and right crawlers 310 and 311, respectively.

The upper turning structure 300 has a cabin 312. In the cabin installed are the traveling control lever devices 34*b*, 34*d* (only one side is shown in FIG. 3), the control lever devices 34*a*, 34*f*-34*h* (partially shown in FIG. 3) for turning, the boom, the arm and the bucket, restrictively. Further, in the cabin installed are the control lever device 34*c* (not shown in FIG. 3) for the blade, and the control lever device 34*e* (not shown in FIG. 3) for swing.

Figure 4:
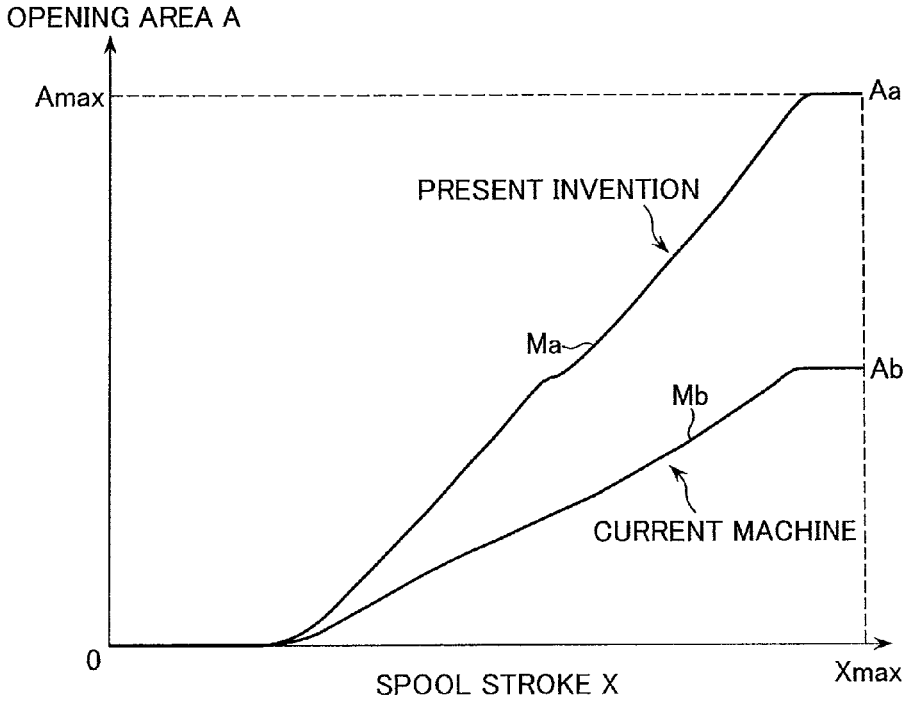
FIG. 4 shows an opening area characteristic of a flow control valve in a traveling valve section for controlling a flow rate of hydraulic fluid fed to a traveling motor.

FIG. 4 shows an opening area characteristic of each of the flow control valves 26*b*, 26*d* in the corresponding traveling valve sections 14, 16 for controlling the flow rate of the hydraulic fluid fed to the corresponding traveling motors 6, 8. In FIG. 4, symbol Ma indicates the opening area characteristic of each of the flow control valves 26*b*, 26*d* according to the present embodiment and symbol Mb indicates a conventional opening area characteristic.

During the travel by the operation of the traveling control lever devices 34*b*, 34*d* in the present embodiment, as described later, the target compensating differential pressures of the travel pressure compensating valves 27*b*, 27*d* lower from pressure Pa to pressure Pa' and differential pressures across the flow control valves 26*b*, 26*d* similarly lower. If the differential pressures are still in this state, the flow rate of the hydraulic fluid fed to the traveling motors 6, 8 will be further reduced than with the conventional manner. In order to ensure the flow rate of the hydraulic fluid fed to the traveling motors 6, 8 in a conventional manner, the opening areas of the flow control valves 26*b*, 26*d* are set larger in accordance with the reduction in the target compensating differential pressure (the differential pressure).

More specifically, if it is assumed that the opening area of the flow control valves 26*b*, 26*d* in the present embodiment is Aa, a conventional opening area of flow control valves of a comparative example is Ab and a flow rate required for travel is Qt, the following relationship therebetween is established.

$$Qt=cAa\sqrt{(2Pa'/\rho)}=cAb\sqrt{/(2Pa/\rho)}$$

c: Flow rate coefficient

ρ: Density of hydraulic fluid

This provides the following relationship.

$$Aa=Ab\sqrt{(Pa/Pa')}$$

Thus, the opening area Aa of the flow rate control valves 26*b*, 26*d* in the present embodiment needs to multiply the opening area Ab of the conventional flow control valves by √(Pa/Pa'). The flow control valves 26*b*, 26*d* are set to have such an opening area characteristic.

Incidentally, instead of the increased opening area of the traveling flow control valves 26*b*, 26*d*, an auxiliary flow control valve may be disposed parallel to the conventional flow control valves to make the total passing flow rate equal to the conventional passing flow rate of the flow control valves. If it is not necessary to make the flow rate of the hydraulic fluid fed to the traveling motors 6, 8 equal to the conventional flow rate, the opening area of the travelling flow control valves 26*b*, 26*d* needs only to be set so as to provide a necessary flow rate.

In the embodiment described above, the shuttle valves 37*a*, 37*b*, and 37*c* constitute a travel detection device which detects whether or not the operation mode is a traveling operation at which the traveling motors 6, 8 are to be driven. The engine revolution speed detection valve device 30 including the flow rate detection valve 30*a* and the differential pressure reducing valve 30*b*, the directional control valve 39, the pressure reducing valve 42 and the pressure-receiving portion 35*d* of the LS control valve 35*b* constitute a setting changing device. On the basis of the detection result of the traveling detection device, the setting changing device sets the target differential pressure of load sensing control at the first prescribed value (the absolute pressure Pa) when the operation mode is not a traveling operation. In addition, the setting changing device sets the target differential pressure of the load sensing control at the second prescribed value (the absolute pressure Pa') smaller than the first prescribed value when the operation mode is a traveling operation.

The engine revolution speed detection valve device 30 including the flow rate detection valve 30*a* and the differential pressure reducing valve 30*b*, the directional control valve 39 and the pressure reducing valve 42 constitute a signal pressure production device. The signal pressure production device produces the first absolute pressure (the absolute pressure Pa) corresponding to the first prescribed value and outputs the first absolute pressure as a signal pressure when the operation mode is not a traveling operation. In addition, the signal pressure production device produces the second absolute pressure (the absolute pressure Pa') corresponding to the second prescribed value and outputs the second absolute pressure as a signal pressure when the operation mode is a traveling operation. The pump control device 35 sets the signal pressure output by the signal pressure production device as the target differential pressure of the load sensing control and controls the displacement volume of the main pump 2.

Further, the pressure reducing valve 42 constitutes a pressure reducing device which reduces the pressure of the pilot hydraulic fluid source 33 to produce and output the second absolute pressure (the absolute pressure Pa'). The directional control valve 39 constitutes a switching device which switches so as to output the first absolute pressure (the absolute pressure Pa) as a signal pressure when the operation mode is not a traveling operation, and output the second absolute pressure (the absolute pressure Pa') as the signal pressure when the operation mode is a traveling operation.

A description is given of the operation of the present embodiment configured as described above.

With the intention of operation other than the travel of the hydraulic excavator, e.g., the raising of the boom, the control lever of the boom control lever device 34*f* may be operated leftward in the figure to operate the remote control valve. In such a case, the control pilot pressure k is produced based on the hydraulic fluid of the pilot hydraulic fluid source 33 and led to the left end side pressure-receiving portion, in the figure, of the flow control valve 26*f* so that the flow control valve 26*f* is switched to the left position on the figure. At this time, the control lever devices 34*b*, 34*d* for traveling operation are not operated; therefore, the directional control valve 39 is at position I to form the first hydraulic circuit. In this first hydraulic circuit, the absolute pressure Pa produced by the differential pressure reducing valve 30*b* is led as the target LS differential pressure to the pressure-receiving portion 35*d* of the LS control valve 35*b*. In this way, the tilting amount (the displacement volume) of the main pump 2 is controlled so that the delivery pressure Pd of the main pump 2 is higher than the maximum load pressure PLmax by the absolute pressure Pa (the target LS differential pressure). The hydraulic fluid discharged from the main pump 2 is fed to the bottom side of the actuator 10 (the boom cylinder) via the flow control valve 26*f* switched as described above to operate the boom 306 (FIG. 3) upward. In this case, the target compensating differential pressure of the boom pressure compensating valve 27*f* is set based on the absolute pressure PLS which is the output pressure of the differential pressure reducing valve 24. If the delivery flow rate of the main pump is not in the insufficient state (is not saturated), the absolute pressure PLS is equal to the absolute pressure Pa which is the target LS differential pressure (the absolute pressure PLS=Pa). Thus, the differential pressure across the boom flow control valve 26*f* is kept at the absolute pressure PLS (=Pa), so that the predetermined flow rate depending on the opening area of the flow control valve 26*f* is fed to the bottom side of the boom cylinder 10.

A plurality of control lever devices may be operated with the intention of the combined operation in which a plurality of actuators are simultaneously driven, excluding the traveling operation of the hydraulic excavator, such as the combined operation of boom-raising and arm-crowding. In such a case, the delivery flow rate of the main pump may possibly be insufficient (may be saturated). If the state occurs where the delivery flow rate of the main pump is insufficient, the delivery pressure of the main pump tends to lower. The absolute pressure PLS which is the output pressure of the differential pressure reducing valve 24 becomes lower than the absolute pressure Pa as the target LS differential pressure (the absolute pressure PLS<Pa). The lowering of the target compensating pressure resulting from the lowering of the absolute pressure PLS occurs in all the pressure compensating valves (e.g. the boom pressure compensating valve 27*f* and the arm pressure compensating valve 27*g*) associated with the combined operation. Therefore, a flow rate ratio corresponding to the opening area ratio among the plurality of flow control valves (e.g. the boom flow control valve 26*f* and the arm flow control valve 26*g*) is maintained. Thus, the smooth combined operation can be done depending on the lever control amount ratios of the control lever devices.

On the other hand, with the intention of straight-ahead travel of the hydraulic excavator for example, the control levers of the traveling control lever devices 34*b*, 34*d* may be operated rightward in the figure to operate the remote control valves 34*b*2, 34*d*2. In such a case, the control pilot pressures d, h are produced based on the hydraulic fluid of the pilot hydraulic fluid source 33 and led to the corresponding pressure-receiving portions, on the right end side in the figure, of the flow control valves 26*b*, 26*d*. Thus, the flow control valves 26*b*, 26*d* are switched to the right position in the figure. Concurrently with this, the control pilot pressures d, h of the remote control valves 34*b*2, 34*d*2 are led to the shuttle valves 37*a*, 37*b*, and 37*c* assembled in tournament form. The highest pressure among the control pilot pressures d, h is led, as the travel signal pressure via the hydraulic line 38, to the pressure-receiving portion 39*a* of the directional control valve 39. Thus, the directional control valve 39 is switched from position I to position II to close the hydraulic line 40 and communicate with the hydraulic line 41 to form the second hydraulic circuit. In the second hydraulic circuit, the hydraulic fluid of the pilot hydraulic fluid source 33 is reduced in pressure by the pressure reducing valve 42 to produce the absolute pressure Pa'. The absolute pressure Pa' is led as the target LS differential pressure to the pressure-receiving portion 35*d* of the control valve 35*b*. The absolute pressure Pa' produced by the pressure reducing valve 42 is set at a level lower than the absolute pressure Pa produced by the differential pressure valve 30*b*. Consequently, the target differential pressure (the target LS differential pressure) of load sensing control lowers from the absolute pressure Pa to the absolute pressure Pa'.

Figure 5:
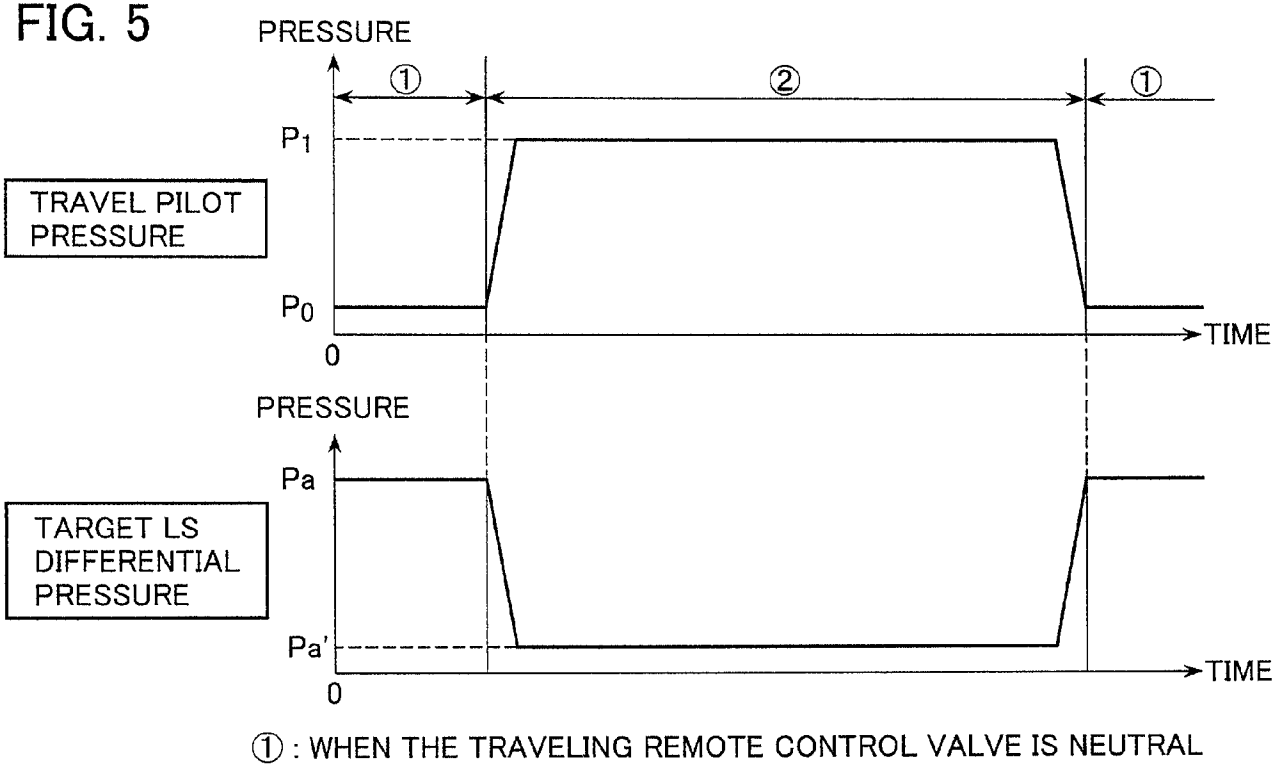
FIG. 5 shows the relationship between the variation of control pilot pressure (travel pilot pressure) and that of target LS differential pressure during the operation of a traveling control lever device.

FIG. 5 shows the relationship between the variation of the control pilot pressures d, h (the travel pilot pressure) and that of the target LS differential pressure when the target differential pressure of the load sensing control lowers from the absolute pressure Pa to the absolute pressure Pa'. In the figure, encircled number 1 denotes time at which the traveling control lever device is neutral (at which the traveling remote control valve is neutral). Encircled number 2 denotes time at which the traveling control lever device is operated (at which the traveling remote control valve is operated). When the remote control valve is neutral, the travel pilot pressure is at P0 equivalent to the tank pressure and the target LS differential pressure is at the absolute pressure Pa produced by the differential pressure reducing valve 30*b*. The absolute pressure Pa is e.g. approximately 2 Mpa. When the remote control valve is operated, the travel pilot pressure rises from P0 to P1 and at the same time the target LS differential pressure lowers from the absolute pressure Pa to the absolute pressure Pa' which is the output pressure of the pressure reducing valve 42. If the remote control valve is fully operated, the travel pilot pressure P1 is e.g. approximately 4 MPa and the absolute pressure Pa' is e.g. approximately 0.7 Mpa.

If the target differential pressure of the load sensing control lowers to the absolute pressure Pa', the opening of the LS control valve 35*b* is rather wide compared with the case where the target differential pressure of the load sensing control is the absolute pressure Pa. therefore more pressure from the pilot hydraulic fluid source 33 is applied to the LS control tilting actuator 35*c*, reducing the tilting angle of the main pump 2, leading to the reduction in the delivery flow rate of the main pump 2. Since the delivery flow rate of the main pump 2 is reduced, the delivery pressure of the main pump 2 is rather low. Thus, the differential pressure between the delivery pressure Pd of the main pump 2 and the maximum load pressure PLmax lowers to the absolute pressure Pa' corresponding to the target LS differential pressure.

The hydraulic fluid discharged from the main pump 2 is fed to the traveling motors 6 and 8 via the flow control valves 26*b* and 26*d*, respectively, switched as described above to drive the crawlers 310 and 311 (FIG. 3) of the lower track structure 301, respectively, allowing the hydraulic excavator to travel. The target compensating pressure of the traveling pressure compensating valves 27*b*, 27*d* is set based on the absolute pressure PLS which is the output pressure of the differential pressure reducing valve 24. If the actuators are the traveling motors 6, 8, the delivery flow rate of the main pump usually does not come into the insufficient state (is not saturated). Therefore, the absolute pressure PLS is equal to the absolute pressure Pa' which is the target LS differential pressure (the absolute pressure PLS=Pa'). The differential pressures across the traveling flow control valves 26*b*, 26*d* are kept at the absolute pressure PLS (=Pa'). A predetermined flow rate according to the opening areas of the flow control valves 26*b*, 26*d* is fed to the traveling motors 6, 8. In this way, a flow rate ratio corresponding to the opening area ratios (the opening area ratio of 1:1 if the hydraulic excavator intends to travel straight) of the traveling flow control valves 26*b*, 26*d* is kept so that the stable straight-ahead traveling can be done regardless of the variation in traveling load pressure. Since the differential pressures across the traveling flow control valves 26*b*, 26*d* lower to the absolute pressure pa', pressure loss inside the control valve 4 can be reduced and the energy loss during the traveling operation is improved.

Both cases following are similar to the case where the control levers of the travel control lever devices 34*b*, 34*d* are operated with the intention of the straight-ahead travel, the cases are: with the intention of the travel and turn of the hydraulic excavator, the control levers of the travel control lever devices 34*b*, 34*d* may be misoperated in operation amounts, and with the intention of the reverse travel, the control levers of the travel control lever devices 34*b*, 34*d* may be operated rightward in the figure. The absolute pressure PLS lowers from Pa to Pa'. With the intention of the straight-ahead travel, the differential pressures across the traveling flow control valves 26*b*, 26*d* lower to the absolute pressure Pa'. The hydraulic fluid at the lowered differential pressures across the flow control valves 26*b*, 26*d* is fed to the traveling motors 6, 8, thereby achieving the intended travel. The differential pressures across the travel flow control valve 26*b*, 26*d* lower to the absolute pressure Pa'; therefore, pressure loss inside the control valve 4 is reduced and energy loss during the traveling operation is improved.

According to the present embodiment as described above, the absolute pressure Pa is set as the target differential pressure of the load sensing control in the actuator operation other than traveling. Therefore, a necessary actuator speed can be hitherto obtained by being supplied with the necessary maximum flow rate. In addition, the differential pressures across the flow control valves 26*a*, 26*c*, 26*e*-26*h* are controlled by use of the corresponding pressure compensating valves 27*a*, 27*c*, 27*e*-27*h*. Under this control, a flow rate in accordance with the opening area ratios of flow control valves can be distributed to actuators different in load pressure from one another during combined operation. Further, during the traveling operation, the target differential pressure of the load sensing control lowers from the absolute pressure Pa to the absolute pressure Pa' to reduce the delivery flow rate of the main pump 2. Therefore, the absolute pressure PLS lowers and the differential pressure across the traveling flow control valves 26*b*, 26*d* controlled by the respective pressure compensating valves 27*b*, 27*d* lowers accordingly to reduce the losing pressure inside the control valve 4. As a result, energy efficiency is enhanced due to less energy loss during traveling operation.

<Second Embodiment>

Figure 6:
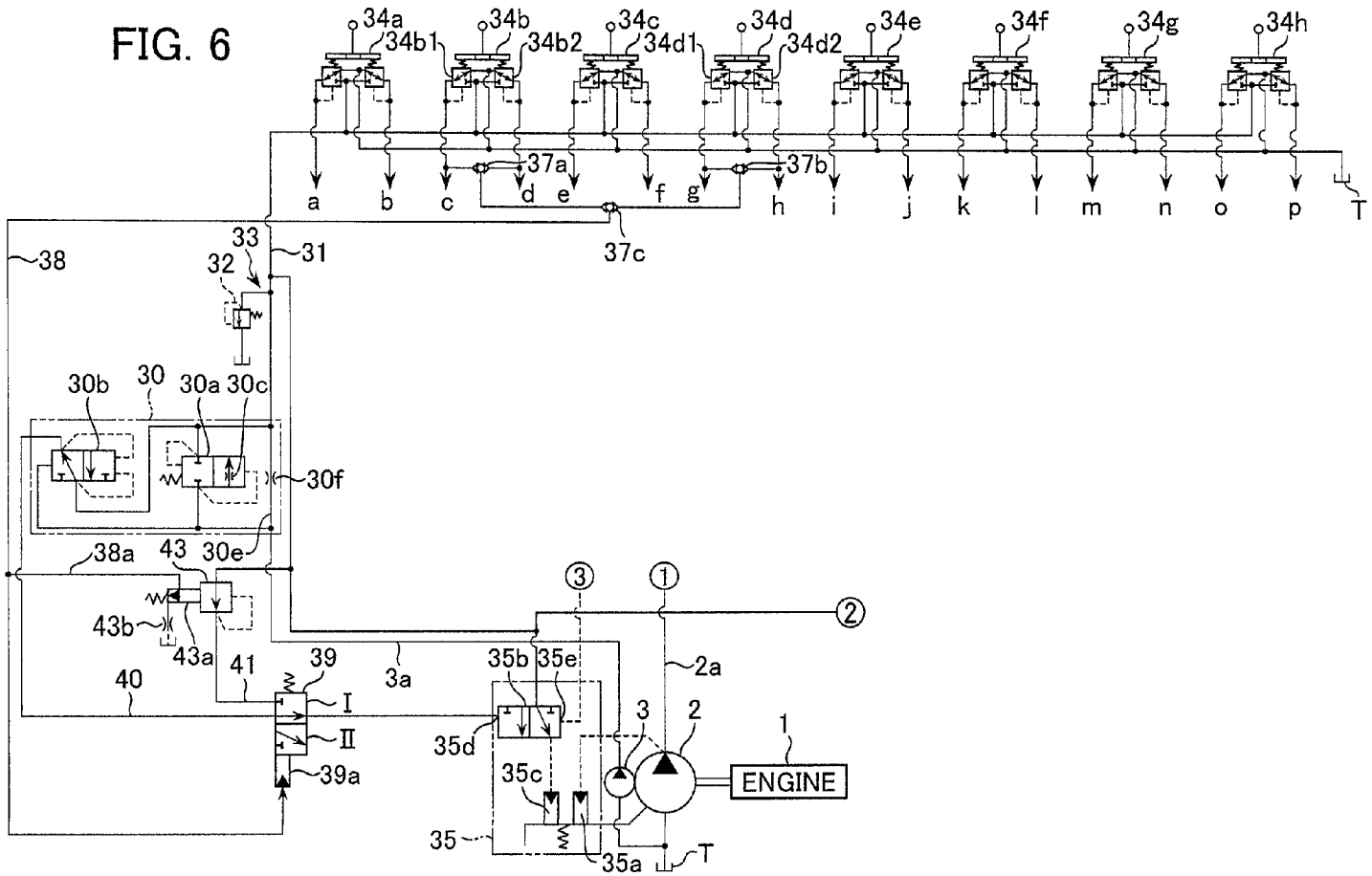
FIG. 6 is a similar drawing to FIG. 1, illustrating a configuration of a hydraulic drive system for a construction machine according to a second embodiment of the present invention.

FIG. 6 is a view similar to FIG. 1, illustrating a configuration of a hydraulic drive system for a construction machine according to a second embodiment of the present invention. The portion corresponding to the control valve of the present embodiment is the same as that shown in FIG. 2.

In the present embodiment, the pressure reducing valve 42 in the second hydraulic circuit is replaced with a pilot operated pressure reducing valve 43.

Referring to FIG. 6, the hydraulic drive system of the present embodiment includes the directional control valve 39 and the pilot operated pressure reducing valve 43. The pilot operated pressure reducing valve 43 is installed in a hydraulic line 41 connecting the pilot hydraulic fluid source 33 with the directional control valve 39, reduces the pressure of the hydraulic fluid of the pilot hydraulic fluid source 33 and outputs an absolute pressure Pa'. The hydraulic drive system is configured to switch the directional control valve 39 to selectively form two circuits: a first hydraulic circuit and a second hydraulic circuit. The first hydraulic circuit leads the absolute pressure Pa, as the target LS differential pressure, produced by the differential pressure reducing valve 30*b* to the pressure-receiving portion 35*d* of the LS control valve 35*b*. The second hydraulic circuit leads the absolute pressure Pa', as the target LS differential pressure, produced from the hydraulic fluid of the pilot hydraulic fluid source 33 via the pilot operated pressure reducing valve 43, to the pressure-receiving portion 35*d* of the LS control valve 35*b*.

The pilot operated pressure reducing valve 43 has a pressure-receiving portion 43*a* acting to reduce the setting (the spring force) of a spring. The pressure-receiving portion 43*a* is connected via a hydraulic line 38*a* to a hydraulic line 38 adapted to lead a travel signal pressure output from shuttle valves 37*a*, 37*b*, and 37*c* assembled in tournament form to a pressure-receiving portion 39*a* of the directional control valve 39. Thus, a traveling signal pressure is led to the pressure-receiving portion 43*a* from each of the travel control remote control valves 34*b*1, 34*b*2, 34*d*1, 34*d*2. The pressure-receiving portion 43*a* is connected to a tank T via a restrictor element 43*b*.

The configurations other than the above are the same as those of the first embodiment.

A description is given of the operation of the present embodiment configured as above.

With the intention of straight-ahead travel of the hydraulic excavator for example, the control levers of traveling control lever devices 34*b*, 34*d* may be operated rightward in the figure to operate respective remote control valves 34*b*2, 34*d*2. In such a case, the control pilot pressures d, h are produced based on the hydraulic fluid of the pilot hydraulic fluid source 33 and led to the pressure-receiving portions, on the right end side in the figure, of the flow control valves 26*b*, 26*d*. Thus, the flow control valves 26*b*, 26*d* are each switched to the right position in the figure. Concurrently with this, the control pilot pressures d, h of the remote control valves 34*b*2, 34*d*2 are led to the shuttle valves 37*a*, 37*b*, and 37*c* assembled in tournament form. The highest pressure among the control pilot pressures d, h is led, as the travel signal pressure via the hydraulic line 38, to a pressure-receiving portion 39*a* of a directional control valve 39. Thus, the directional control valve 39 is switched from position I to position II to close the hydraulic line 40 and communicate with the hydraulic line 41 to form the second hydraulic circuit. In the second hydraulic circuit, the hydraulic fluid of the pilot hydraulic fluid source 33 is reduced in pressure by the pilot operated pressure reducing valve 43 to produce the absolute pressure Pa'. The absolute pressure Pa' is led as the target LS differential pressure to a pressure-receiving portion 35*d* of a control valve 35*b*. The absolute pressure Pa' produced by the pilot operated pressure reducing valve 43 is set at a pressure lower than the absolute pressure Pa produced by the differential pressure reducing valve 30*b*. Consequently, the delivery flow rate of the main pump 2 controlled by a LS control valve 35*b* and a LS control tilting actuator 35*c* is reduced so that the delivery pressure of the main pump 2 becomes rather low. The differential pressure between the delivery pressure Pd of the main pump 2 and the maximum load pressure PLmax lowers to the absolute pressure Pa'. Thus, the absolute pressure PLS which is the output pressure of the differential pressure reducing valve 24 is lowered to Pa', also the target compensating differential pressures of the travel pressure compensating valves 27*b*, 27*d* are lowered to the absolute pressure Pa' and the differential pressures across the travel flow control valves 26*b*, 26*d* are kept at the lowered absolute pressure Pa'.

Also in the present embodiment described above, the flow rate ratio corresponding to the opening area ratio of the travel flow control valves 26*b*, 26*d* is kept so that stable straight-ahead traveling can be done. In addition, the differential pressures across the travel flow control valves 26*b*, 26*d* are lowered to the absolute pressure Pa'. Therefore, the losing pressure inside the control valve 4 is reduced and energy loss during the traveling operation is decreased.

In the present embodiment, the travel signal pressure of the traveling-operation remote control valves 34*b*2, 34*d*2 is led to the pressure-receiving portion 43*a* of the pilot operated pressure reducing valve 43. The pressure acts to reduce the setting of the spring (the spring force) for reducing pressure and due to the operation of the restrictor 43*b* installed on the exit side of the pressure-receiving portion 43*a*, the travel signal pressure acting on the pressure-receiving portion 43*a* reduces moderately the setting of the spring (the spring force). This, therefore, produces a moderate reduction in the target differential pressure of the load sensing control at the starting time of traveling operation, thereby improving traveling operability.

According to the present embodiment, traveling operability can be improved by controlling a rapid change in the target differential pressure of the load sensing control as well as the same effect (improvement energy loss during the traveling operation) as that of the first embodiment can be obtained.

<Third Embodiment>

Figure 7:
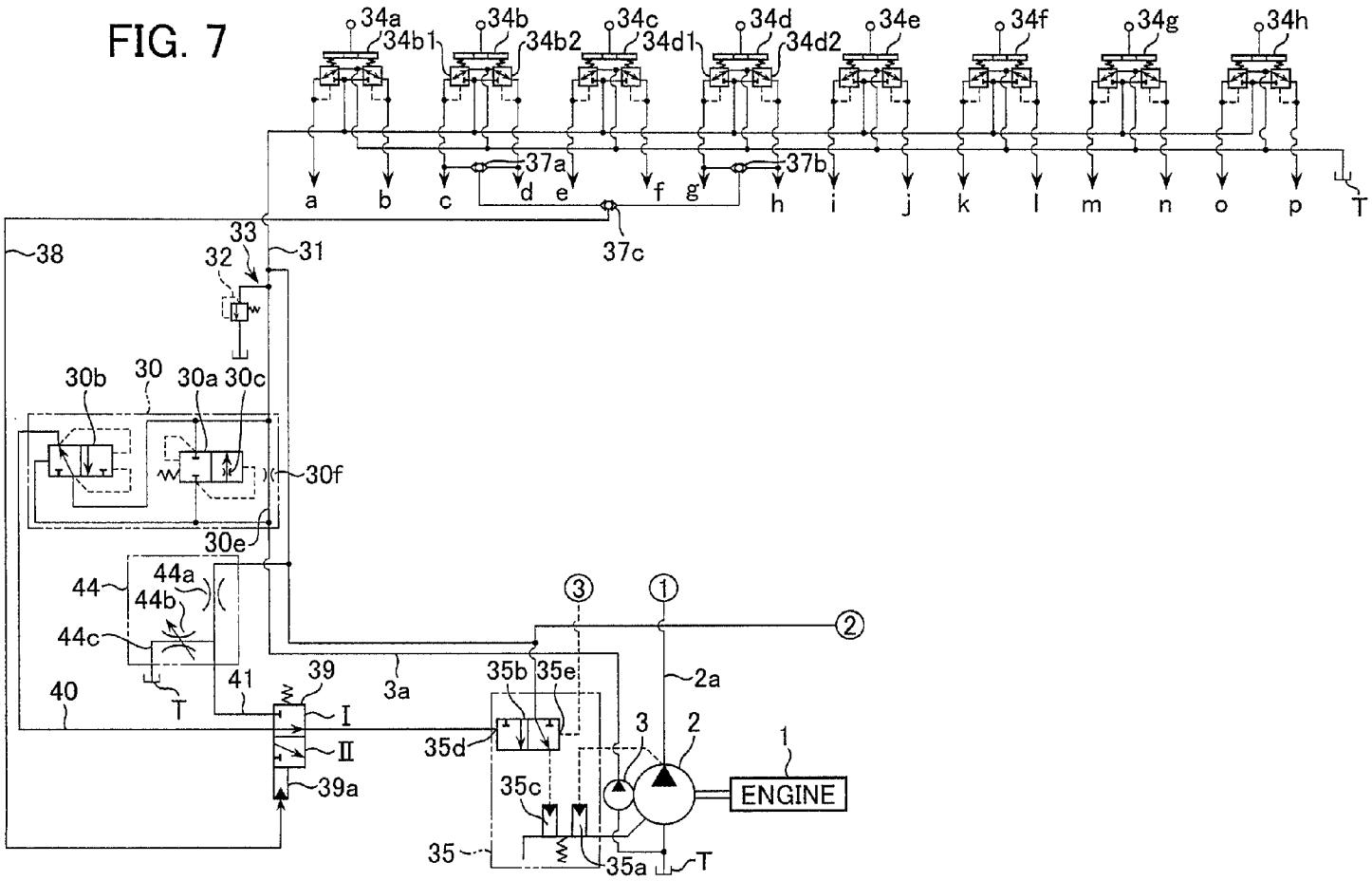
FIG. 7 is a similar drawing to FIG. 1, illustrating a configuration of a hydraulic drive system for a construction machine according to a third embodiment of the present invention.

FIG. 7 is a view similar to FIG. 1, illustrating a configuration of a hydraulic drive system for a construction machine according to a third embodiment of the present invention. The portion corresponding to the control valve of the present embodiment is the same as that shown in FIG. 2.

In the present embodiment, the pressure reducing valve 42 in the second hydraulic circuit is replaced with a pressure-dividing circuit 44.

Referring to FIG. 7, the hydraulic drive system of the present embodiment includes directional control valve 39 and the pressure-dividing circuit 44. The pressure-dividing circuit 44 is installed in a hydraulic line 41 connecting the pilot hydraulic fluid source 33 with the directional control valve 39, reduces the pressure of the hydraulic fluid of the pilot hydraulic fluid source 33 and outputs an absolute pressure Pa'. The hydraulic drive system is configured to switch the directional control valve 39 to selectively form two circuits: a first hydraulic circuit and a second hydraulic circuit. The first hydraulic circuit leads the absolute pressure Pa, as the target LS differential pressure, produced by the differential pressure reducing valve 30*b* to the pressure-receiving portion 35*d* of the LS control valve 35*b*. The second hydraulic circuit leads the absolute pressure Pa', as the target LS differential pressure, produced from the hydraulic fluid of the pilot hydraulic fluid source 33 via the pressure-dividing circuit 44, to the pressure-receiving portion 35*d* of the LS control valve 35*b*.

The pressure-dividing circuit 44 includes a fixed restrictor element 44*a* located in the hydraulic line 41 and a variable restrictor element 44*b* located in a hydraulic line 44*c* diverging from the downstream side of the fixed restrictor element 44*a*. The variable restrictor element 44*b* is connected to the tank T on the downstream side thereof. An intermediate pressure resulting from dividing the pressure of the hydraulic fluid through the fixed restrictor element 44*a* and the variable restrictor element 44*b* is output as the absolute pressure Pa'. The flow rate discharged to the tank T is determined from the restrictor diameter (the opening area) of the variable restrictor element 44*b*. Thus a pressure-dividing ratio between the fixed restrictor element 44*a* and the variable restrictor element 44*b* is determined, that is, the intermediate pressure (the absolute pressure Pa' which is the output pressure) is determined. The variable restrictor element 44*b* is provided with an operating portion such as a set screw or the like. An operator operates the operating portion from the outside with a driver or the like to change the restrictor diameter (the opening area) of the variable restrictor element 44*b*, which regulates the pressure-dividing ratio, thereby allowing for changing the output pressure (the absolute pressure Pa').

The configurations other than the above are the same as those of the first embodiment.

A description is given of the operation of the present embodiment configured as described above.

For example, with the intention of straight-ahead travel of the hydraulic excavator for example, the control levers of traveling control lever devices 34*b*, 34*d* may be operated rightward in the figure to operate respective remote control valves 34*b*2, 34*d*2. In such a case, the control pilot pressures d, h are produced based on the hydraulic fluid of the pilot hydraulic fluid source 33 and led to the pressure-receiving portions, on the right end side in the figure, of the flow control valves 26*b*, 26*d*. Thus, the flow control valves 26*b*, 26*d* are each switched to the right position in the figure. Concurrently with this, the control pilot pressures d, h of the remote control valves 34*b*2, 34*d*2 are led to the shuttle valves 37*a*, 37*b*, and 37*c* assembled in tournament form. The highest pressure among the control pilot pressures d, h is led, as the travel signal pressure via the hydraulic line 38, to a pressure-receiving portion 39*a* of a directional control valve 39. Thus, the directional control valve 39 is switched from position I to position II to close the hydraulic line 40 and communicate with the hydraulic line 41 to form the second hydraulic circuit. In the second hydraulic circuit, the hydraulic fluid of the pilot hydraulic fluid source 33 is reduced in pressure by the pressure-dividing circuit 44 to produce the absolute pressure Pa'. The absolute pressure Pa' is led as the target LS differential pressure to a pressure-receiving portion 35*d* of a control valve 35*b*. The absolute pressure Pa' produced by the pressure-dividing circuit 44 is set at a pressure lower than the absolute pressure Pa produced by the differential pressure valve 30*b*. Consequently, the delivery flow rate of the main pump 2 controlled by a LS control valve 35*b* and a LS control tilting actuator 35*c* is reduced so that the delivery pressure of the main pump 2 becomes rather low. The differential pressure between the delivery pressure Pd of the main pump 2 and the maximum load pressure PLmax lowers to the absolute pressure Pa'. Thus, the absolute pressure PLS which is the output pressure of the differential pressure reducing valve 24 is lowered to Pa', also the target compensating differential pressures of the travel pressure compensating valves 27*b*, 27*d* are lowered to the absolute pressure Pa' and the differential pressures across the travel flow control valves 26*b*, 26*d* are kept at the lowered absolute pressure Pa'.

Also in the present embodiment described above, the flow rate ratio corresponding to the opening area ratio of the travel flow control valves 26*b*, 26*d* is kept so that stable straight-ahead traveling can be done. In addition, the differential pressures across the travel flow control valves 26*b*, 26*d* are lowered to the absolute pressure Pa'. Therefore, the losing pressure inside the control valve 4 is reduced and energy loss during the traveling operation is improved.

In the present embodiment, the pressure-dividing circuit 44 can increase the amount of reducing pressure by changing the restrictor diameter (the opening area) of the variable restrictor element 44*b*. Thus, the absolute pressure Pa' which is the output pressure can freely be regulated.

According to the present embodiment, the flexibility in the design is increased by facilitating the adjustment and setting of the value of the absolute pressure Pa' as well as the same effect (improvement energy loss during the traveling operation) as that of the first embodiment can be obtained.

<Fourth Embodiment>

Figure 8:
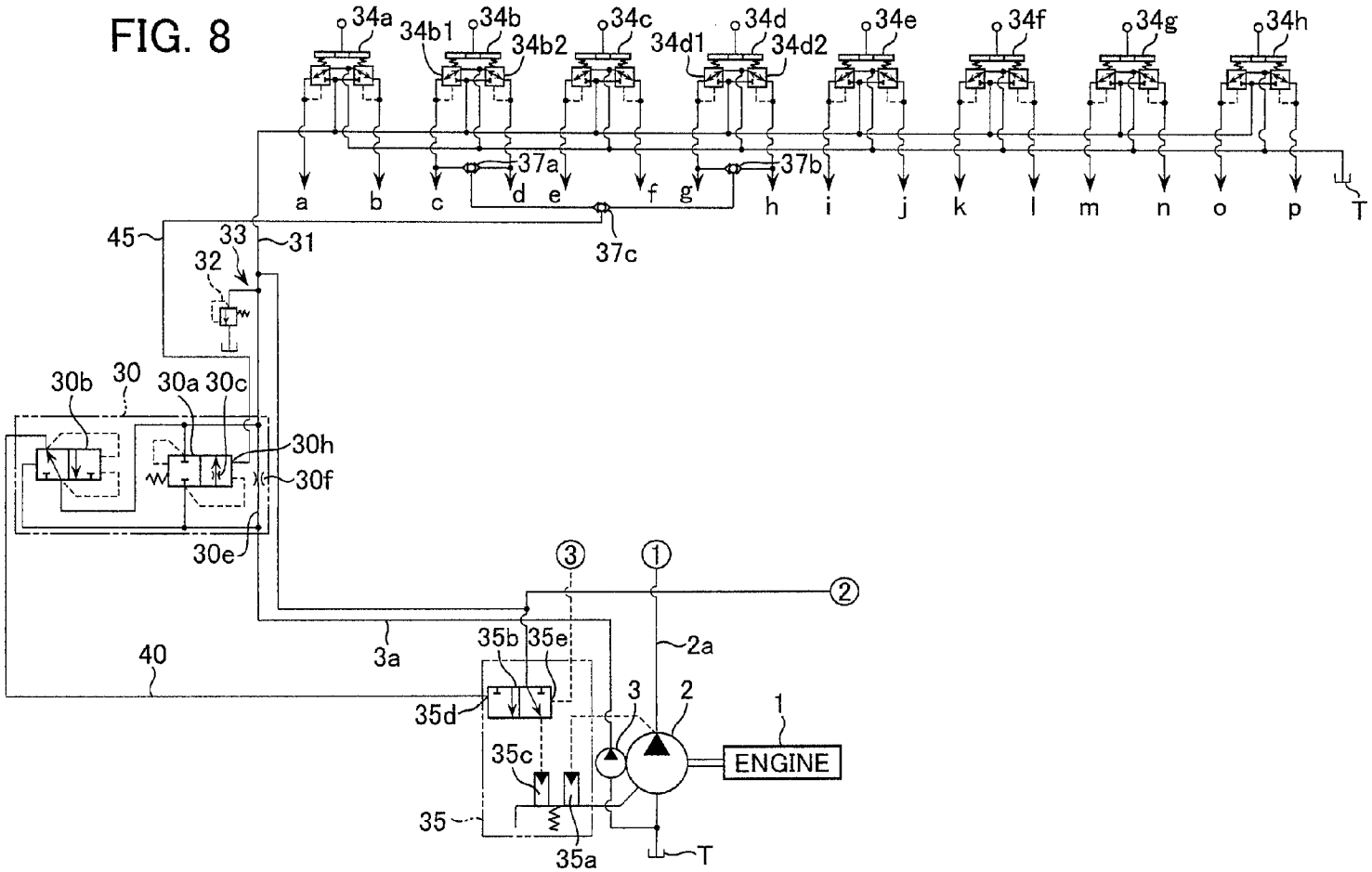
FIG. 8 is a similar drawing to FIG. 1, illustrating a configuration of a hydraulic drive system for a construction machine according to a fourth embodiment of the present invention.

FIG. 8 is a view similar to FIG. 1, illustrating a configuration of a hydraulic drive system for a construction machine according to a fourth embodiment of the present invention. The portion corresponding to the control valve of the present embodiment is the same as that shown in FIG. 2.

The present embodiment allows the flow rate detection valve 30*a* to have the function of the pressure-reducing valve 42 in the second hydraulic circuit, and allows the first hydraulic circuit to have the function of the second hydraulic circuit.

Referring to FIG. 8, a flow control valve 30*a* has a pressure-receiving portion 30*h* acting to open a variable restrictor portion 30*c*. The traveling signal pressure output from the shuttle valves 37*a*, 37*b*, and 37*c* is led via a signal hydraulic line 45 to a pressure-receiving portion 30*h* of a flow rate detection valve 30*a*. The travel signal pressure led to the pressure-receiving portion 30*h* acts to open the variable restrictor portion 30*c* of the flow rate detection valve 30*a*. Therefore, the differential pressure across the variable restrictor portion 30*c* of the flow control valve 30*a* is lowered accordingly. The differential pressure reducing valve 30*b* outputs the lowered differential pressure across the variable restrictor portion 30*c* as the absolute pressure Pa'. The absolute pressure Pa' is led as the target LS differential pressure to the pressure-receiving portion 35*d* of the LS control valve 35*b* via the hydraulic line 40.

The configurations other than the above are the same as those of the first embodiment.

A description is given of the operation of the embodiment configured as above.

With the intention of straight-ahead travel of the hydraulic excavator for example, the control levers of the traveling control lever devices 34*b*, 34*d* may be operated rightward in the figure to operate the remote control valves 34*b*2, 34*d*2. In such a case, the control pilot pressures d, h are produced based on the hydraulic fluid of the pilot hydraulic fluid source 33 and led to the pressure-receiving portions, on the right end side in the figure, of the flow control valves 26*b*, 26*d*. Thus, the flow control valves 26*b*, 26*d* are each switched to the right position in the figure. Concurrently with this, the control pilot pressures d, h of the remote control valves 34*b*2, 34*d*2 are led to the shuttle valves 37*a*, 37*b*, 37*c* assembled in tournament form. The highest pressure among the control pilot pressures d, h is led as the travel signal pressure via the hydraulic line 45 to the pressure-receiving portion 30*h* of the flow rate detection valve 30*a*. Thus, the opening area of the variable restrictor portion 30*c* is increased and the differential pressure across the variable restrictor portion 30*c* is lowered accordingly. Since the differential pressure across the variable restrictor portion 30*c* is lowered, the absolute pressure Pa produced by the differential pressure reducing valve 30*b* is reduced to the absolute pressure Pa'. The absolute pressure Pa' is led to the pressure-receiving portion 35*d* of the LS control valve 35*b* as the target LS differential pressure, and the target LS differential pressure is lowered from the absolute pressure Pa to the absolute pressure Pa'.

Figure 9:
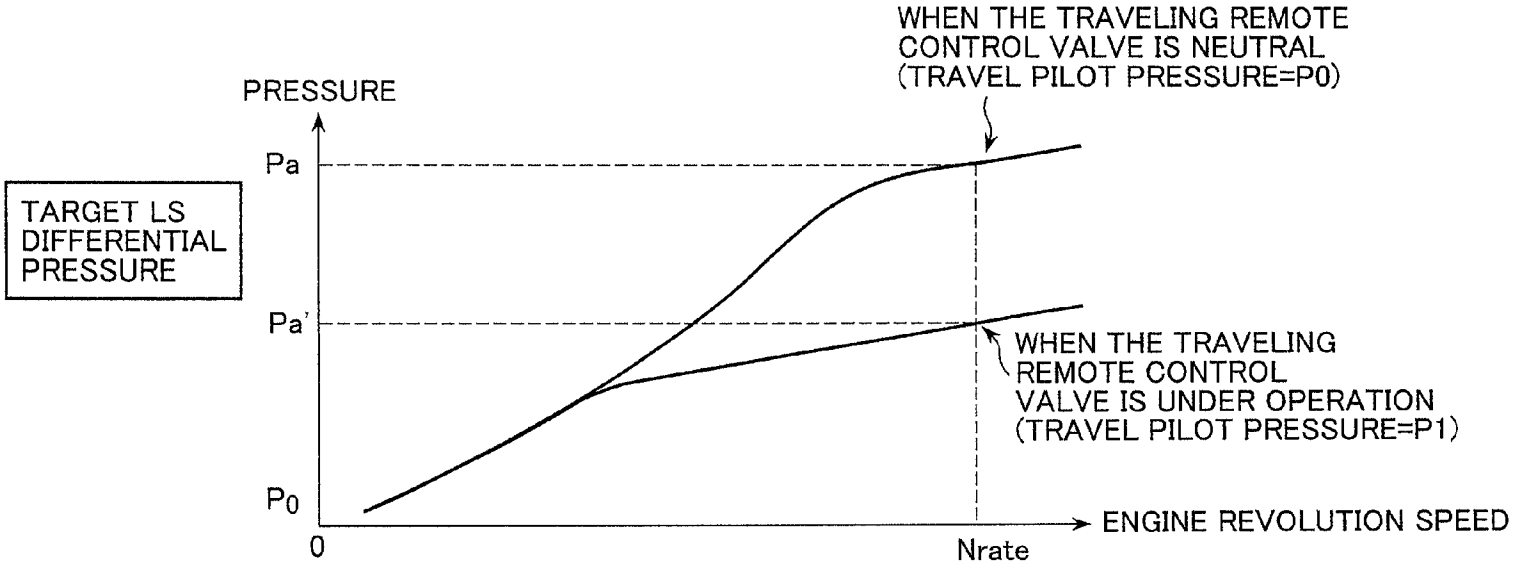
FIG. 9 shows variations in target LS differential pressure of when the traveling control lever device is neutral (when the traveling remote control valve is neutral) and when the traveling control lever device is under operation (when the traveling remote control valve is under operation).

FIG. 9 shows the variations in target LS differential pressure: when the traveling control lever device is neutral (when the traveling remote control valve is neutral); and when the traveling control lever device is under operation (when the traveling remote control valve is under operation). In FIG. 9, the abscissa axis indicates the engine revolution speed. When the traveling remote control valve is neutral, the target LS differential pressure rises as the engine revolution speed is increased. At a rated revolution speed Nrate, the target LS differential pressure is the absolute pressure Pa which is the output pressure of the differential pressure reducing valve

30*b* (the function of the engine revolution speed detection valve device 30). When the traveling remote control valve is under operation, the rising rate of the target LS differential pressure is smaller from the midway of the rise of the engine revolution speed than that when the traveling remote control valve is neutral. At the rated revolution speed Nrate, the target LS differential pressure is at Pa' lower than Pa (the effect resulting from leading the travel signal pressure to the flow rate detection valve 30*a*).

If the target LS differential pressure lowers from the absolute pressure Pa to the absolute pressure Pa' when the traveling remote control valve is under operation, the absolute pressure PLS which is the output pressure of the differential pressure reducing valve 24 lowers to Pa'. Also the target compensating differential pressures of the traveling pressure compensating valve 27*b*, 27*d* lowers to Pa'. The differential pressures across the traveling flow control valves 26*b*, 26*d* are kept at the lowering absolute pressure Pa'.

Also in the present embodiment described above, the flow rate corresponding to the opening area ratio of the travel flow control valves 26*b*, 26*d* is kept so that stable straight-ahead traveling can be done. In addition, the differential pressures across the travel flow control valves 26*b*, 26*d* are lowered to the absolute pressure Pa'. Therefore, the losing pressure inside the control valve 4 is reduced and the energy loss during the traveling operation is improved.

The present embodiment can switch from the absolute pressure Pa to the absolute pressure Pa' only by leading the travel signal pressure (the control pressure) to the flow rate detection valve 30*a* without providing the additional pressure-reducing means and directional control valve like the embodiments described earlier. Thus, the signal pressure production device (the setting changing device) can be composed with a small number of component parts.

The present embodiment can reduce the manufacturing cost of the hydraulic drive system by composing the signal pressure production device (the setting changing device) with a small number of component parts as well as obtaining the same effect (improvement energy efficiency during the traveling operation) as that of the first embodiment.

<Fifth Embodiment>

Figure 10:
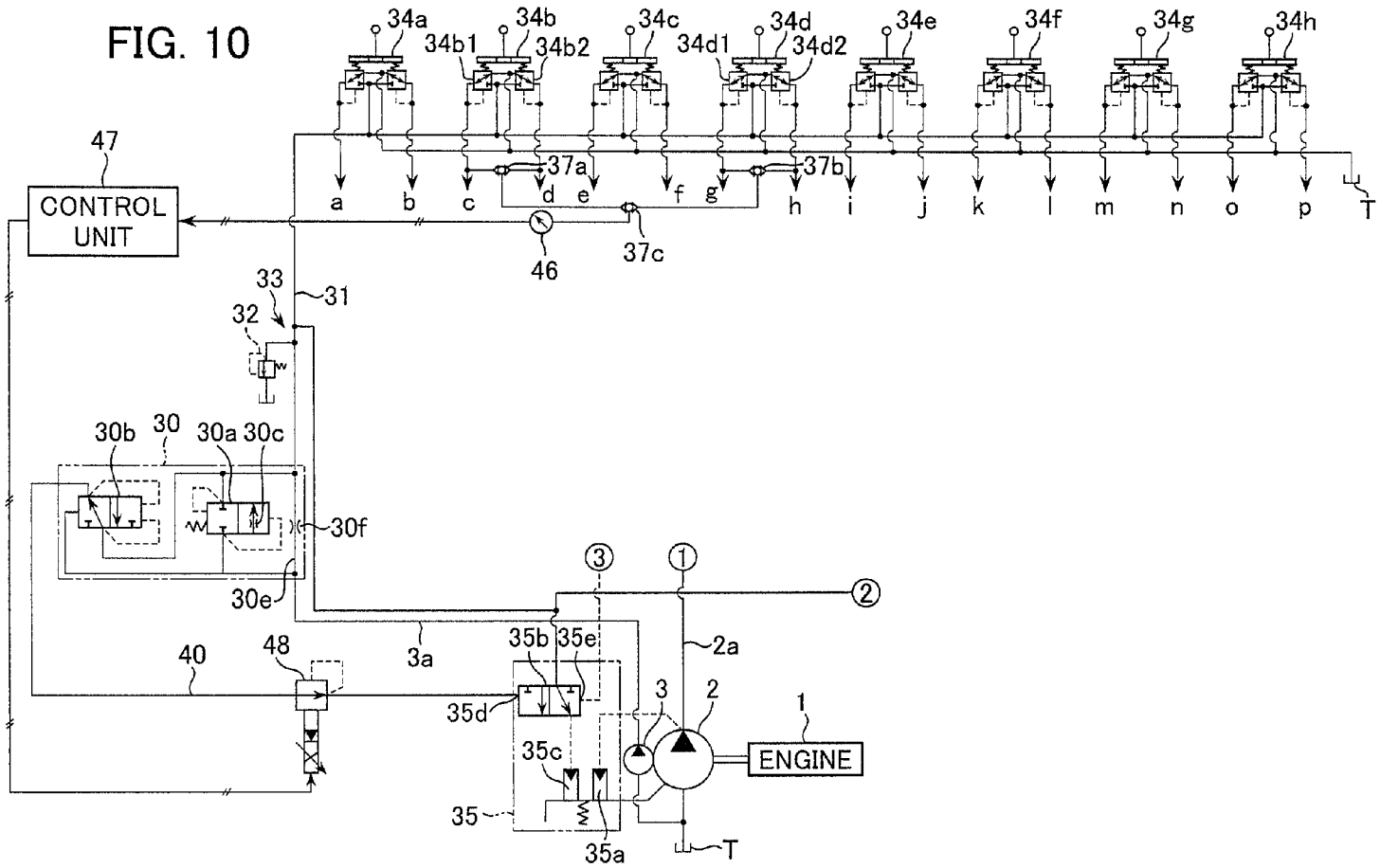
FIG. 10 is a similar drawing to FIG. 1, illustrating a configuration of a hydraulic drive system for a construction machine according to a fifth embodiment of the present invention.

FIG. 10 is a view similar to FIG. 1, illustrating a configuration of a hydraulic drive system for a construction machine according to a fifth embodiment of the present invention. The portion corresponding to the control valve of the present embodiment is the same as that shown in FIG. 2.

The present embodiment realizes the function of the pressure reducing valve 42 and the directional control valve 39 in the second hydraulic circuit by use of electric control and allows the first hydraulic circuit to have the function of the second hydraulic circuit.

Referring to FIG. 10, the hydraulic drive system of the present embodiment includes a pressure sensor 46 for detecting the travel signal pressure output from the shuttle valves 37*a*, 37*b*, and 37*c*; a control unit 47; and a solenoid proportional pressure reducing valve 48. The control unit 47 receives a detection signal of the pressure sensor 46 to monitor whether or not the travel signal pressure rises from a tank pressure P0 to a pressure P1 when the remote control valve is under operation. If the travel signal pressure rises from P0 to P1, the control unit 47 determines that the operation mode is a traveling operation and outputs a control electric signal to the solenoid proportional pressure reducing valve 48. The solenoid proportional pressure reducing valve 48 is disposed in a hydraulic line 40 adapted to lead the absolute pressure Pa output from the differential pressure reducing valve 30*b* to the pressure-receiving portion 35*d* of the LS control valve 35*b*. Upon receipt of the control electric signal from the control unit 47 the solenoid proportional pressure reducing valve 48 operates to reduce the absolute pressure Pa output from the differential pressure reducing valve 30*b* to the absolute pressure Pa' and output the resultant pressure.

The configurations other than the above are the same as those of the first embodiment.

Also in the present embodiment configured as described above, at the time of operation of the traveling control lever devices (at the time of operation of the remote control valves), the target LS differential pressure lowers from the absolute pressure Pa to the absolute pressure Pa' and also the target differential pressures of the travelling pressure compensating valves 27*b*, 27*d* lower to Pa'. Therefore, the flow rate ratio corresponding to the opening area ratio of the traveling flow control valves 26*b*, 26*d* is kept so that stable straight-ahead traveling can be done. In addition, the differential pressures across the traveling flow control valves 26*b*, 26*d* lower to the absolute pressure Pa'. Thus, the losing pressure inside the control valve 4 is reduced and energy loss during the traveling operation is decreased.

The present embodiment uses the control unit 47 and the solenoid proportional pressure reducing valve 48 to produce the absolute pressure Pa' which is the second prescribed value. Therefore, the control electric signal can arbitrarily be changed by arithmetic processing of the control unit 47 so that the absolute pressure Pa' can be regulated freely.

<Other Embodiments>

The embodiments described above can be modified in various ways within the scope of the spirit of the present invention. In the above embodiments, for example, the target compensating differential pressure is set by leading the output pressure (the absolute pressure PLS of the differential pressure between the pump pressure Pd and the maximum load pressure PLmax) of the differential pressure reducing valve 24 to the pressure-receiving portions 28*a*-28*h* of the pressure compensating valves 27*a*-27*h*. However, pressure-receiving portions may be each provided so as to face a corresponding one of the pressure compensating valves 27*a*-27*h*. In addition, the pump pressure Pd and the maximum load pressure PLmax may be individually led to the pressure-receiving portions for setting the target compensating pressures.

The embodiments described above uses the pressure, depending on the revolution speed of the engine output by the differential pressure reducing valve 30*b*, for the absolute pressure Pa as the first prescribed value. However, the hydraulic excavator travels with the engine revolution speed made constant during the traveling operation. Therefore, the pressure of the pilot hydraulic fluid source 33 may be reduced to produce the absolute pressure Pa, which may be used as the first prescribed value.

Further, the above embodiments describe the case where the construction machine is the hydraulic excavator. However, as long as construction machines are provided with the traveling motors, the present invention can be applied to the construction machines (e.g. a hydraulic crane, a wheel-type excavator, and so on) other than the hydraulic excavator and produce the same effects.

EXPLANATION OF REFERENCE NUMERALS

1 Engine
2 Main pump
2*a* Supply hydraulic line
3 Pilot pump
3*a* Supply hydraulic line
5-12 Actuator

5 Turning motor
6, 8 Traveling motor
7 Blade cylinder
9 Swing cylinder
10 Boom cylinder
11 Arm cylinder
12 Bucket cylinder
13-20 Valve section
21 Signal hydraulic line
22*a*-22*g* Shuttle valve
23 Main relief valve
24 Differential pressure reducing valve
25 Unloading valve
25*a* Spring
26*a*-26*h* Flow control valve (main spool)
27*a*-27*h* Pressure compensating valve
30 Engine revolution speed detection valve device
30*a* Flow rate detection valve
30*b* Differential pressure reducing valve
30*c* Variable restrictor portion
30*e* Hydraulic line
30*f* Restrictor element
30*h* Pressure-receiving portion
31 Pilot hydraulic line
32 Pilot relief valve
3 Pilot hydraulic fluid source
34*a*-34*h* Traveling control lever device
34*b*1, 34*b*2, 34*d*1, 34*d*2 Traveling remote control valve
35 Pump control device
35*a* Horsepower control tilting actuator
35*b* LS control valve
35*c* LS control tilting actuator
35*d*, 35*e* Pressure-receiving portion
37*a*-37*c* Shuttle valve
38 Hydraulic line
38*a* Hydraulic line
39 Directional control valve
39*a* Pressure-receiving portion
40 Hydraulic line
41 Hydraulic line
42 Pressure reducing valve
43 Pilot operated pressure reducing valve
43*a* Pressure-receiving portion
43*b* Restrictor element
44 Pressure-dividing circuit
44*a* Fixed restrictor element
44*b* Variable restrictor element
44*c* Hydraulic line
45 Signal hydraulic line
46 Pressure sensor
47 Control unit
48 Solenoid proportional pressure reducing valve
300 Upper turning structure
301 lower track structure
302 Front work device
303 Swing post
304 Central frame
305 Blade
306 Boom
307 Arm
308 Bucket

The invention claimed is:

1. A hydraulic drive system for a construction machine, comprising:

an engine;

a variable displacement main pump driven by the engine;

a plurality of actuators including traveling hydraulic motors, each of the traveling hydraulic motors being driven by hydraulic fluid delivered from the main pump;

a plurality of flow control valves including traveling flow control valves, the flow control valves connected to control flow rates of the hydraulic fluid fed to the plurality of actuators from the main pump;

a pump control device connected to the main pump to exercise load sensing control on a displacement volume of the main pump so that a delivery pressure of the main pump is higher than a maximum load pressure of the plurality of actuators by a target differential pressure;

a plurality of pressure compensating valves connected to the plurality of flow control valves, where the plurality of pressure compensating valves each control to keep a differential pressure across a corresponding one of the flow control valves at a differential pressure between the delivery pressure of the main pump and the maximum load pressure of the plurality of actuators;

a plurality of shuttle valves to detect whether or not an operation mode is a traveling operation in which the traveling hydraulic motors are to be driven; and a setting changing device connected with the pump control device to set the target differential pressure of the load sensing control at a first value when the operation mode is not the traveling operation, and to set the target differential pressure of the load sensing control at a second value lower than the first value when the operation mode is the traveling operation, the setting changing device including a signal pressure production device to produce a signal pressure at a first absolute pressure corresponding to the first value when the operation mode is not the traveling operation, and to produce the signal pressure at a second absolute pressure corresponding to the second value when the operation mode is the traveling operation, wherein the pump control device sets the target differential pressure of the load sensing control as the signal pressure output by the signal pressure production device and controls the displacement volume of the main pump, wherein the signal pressure production device includes:

a differential pressure reducing valve to produce the first absolute pressure according to a revolution speed of the engine driving the main pump;

a pressure reducing valve to reduce a pressure of a pilot hydraulic fluid source and produce the second absolute pressure from the reduced pressure of the pilot hydraulic fluid source; and a direction control valve to switch between the first absolute pressure as the signal pressure when the operation mode is not the traveling operation and the second absolute pressure as the signal pressure when the operation mode is the traveling operation.

2. A hydraulic drive system for a construction machine, comprising:

an engine;

a variable displacement main pump driven by the engine;

a pilot pump driven by the engine;

a plurality of actuators including traveling hydraulic motors, each of the traveling hydraulic motors being driven by hydraulic fluid delivered from the main pump;

a plurality of flow control valves including traveling flow control valves, the flow control valves connected to control flow rates of the hydraulic fluid fed to the plurality of actuators from the main pump;

a pump control device connected to the main pump to exercise load sensing control on a displacement volume of the main pump so that a delivery pressure of the main pump is higher than a maximum load pressure of the plurality of actuators by a target differential pressure;

a plurality of pressure compensating valves connected to the plurality of flow control valves, where the plurality of pressure compensating valves each control to keep a differential pressure across a corresponding one of the flow control valves at a first differential pressure between the delivery pressure of the main pump and the maximum load pressure of the plurality of actuators;

a plurality of shuttle valves to detect whether or not an operation mode is a traveling operation in which the traveling hydraulic motors are to be driven; and a setting changing device connected with the pump control device to set the target differential pressure of the load sensing control at a first value when the operation mode is not the traveling operation, and to set the target differential pressure of the load sensing control at a second value lower than the first value when the operation mode is the traveling operation, the setting changing device including a signal pressure production device to produce a signal pressure at a first absolute pressure corresponding to the first value when the operation mode is not the traveling operation, and to produce the signal pressure at a second absolute pressure corresponding to the second value when the operation mode is the traveling operation, wherein the pump control device sets the target differential pressure of the load sensing control as the signal pressure output by the signal pressure production device and controls the displacement volume of the main pump, wherein the signal pressure production device includes:

a flow rate detection valve connected to receive hydraulic fluid from the pilot pump where a second differential pressure across the flow rate detection valve changes in accordance with a passing flow rate of the hydraulic fluid from the pilot pump; and a differential pressure reducing valve connected to the flow rate detection valve to produce the second differential pressure across the flow rate detection valve as the first absolute pressure, wherein the flow rate detection valve includes a pressure-receiving portion to receive a control pressure when the operation mode is the traveling operation and to open a variable restrictor portion of the flow rate detection valve;

wherein the differential pressure reducing valve produces, as the first absolute pressure, the second differential pressure across the flow rate detection valve in which the control pressure is not led to the pressure-receiving portion when the operation mode is not the traveling operation, and wherein the differential pressure reducing valve produces, as the second absolute pressure, the second differential pressure across the flow rate detection valve in which the control pressure is led to the pressure-receiving portion when the operation mode is the traveling operation.

* * * * *